US012232551B2

(12) United States Patent
Bauters et al.

(10) Patent No.: US 12,232,551 B2
(45) Date of Patent: Feb. 25, 2025

(54) RESPIRATOR

(71) Applicant: Milwaukee Electric Tool Corporation, Brookfield, WI (US)

(72) Inventors: Trent T. Bauters, West Allis, WI (US); Alexander J. Paulsen, Milwaukee, WI (US); Aaron M. Williams, Milwaukee, WI (US); Adam M. Moller, Brookfield, WI (US); Benjamin T. Jones, St. Francis, WI (US); Aaron S. Blumenthal, Shorewood, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 913 days.

(21) Appl. No.: 17/165,585

(22) Filed: Feb. 2, 2021

(65) Prior Publication Data

US 2021/0235790 A1 Aug. 5, 2021

Related U.S. Application Data

(63) Continuation of application No. PCT/US2021/016182, filed on Feb. 2, 2021.
(Continued)

(51) Int. Cl.
*A41D 13/11* (2006.01)

(52) U.S. Cl.
CPC ..... *A41D 13/1161* (2013.01); *A41D 2300/33* (2013.01); *A41D 2300/332* (2013.01); *A41D 2300/50* (2013.01)

(58) Field of Classification Search
CPC ..... A41D 13/1161; A41D 2300/33; A41D 2300/332; A41D 2300/50; A62B 23/00;
(Continued)

(56) References Cited

U.S. PATENT DOCUMENTS 2,414,405 A 1/1947 Bierman et al.
2,814,293 A 11/1957 Gabb et al.
(Continued)

FOREIGN PATENT DOCUMENTS

CN 1294527 A 5/2001
CN 101765444 A 6/2010
(Continued)

OTHER PUBLICATIONS

International Search Report and Written Opinion for International Application No. PCT/US2021/016182, dated Apr. 29, 2021, 10 pages.

*Primary Examiner* — Ophelia A Hawthorne
*Assistant Examiner* — Michael Milo
(74) *Attorney, Agent, or Firm* — Reinhart Boerner Van Deuren s.c.

(57) ABSTRACT

A tool, such as a respirator or gas mask, is provided. The respirator includes a body, a filter, an upper and lower strap, and a locking mechanism. The locking mechanism enables quick-release for fitting and/or adjusting the respirator on a user's head or face. In various embodiments, inelastic and elastic properties of the straps and/or a cord in the entwined region of the locking mechanism enhance the quick-release fit and adjustment of the locking mechanism.

23 Claims, 17 Drawing Sheets

Related U.S. Application Data

(60) Provisional application No. 62/969,372, filed on Feb. 3, 2020.

(58) Field of Classification Search
CPC ..... B01D 27/00; B01D 29/39; B01D 35/06; B01D 46/00; B01D 61/00; B01D 61/14; B01D 61/42; B01D 61/425; B01D 61/44; B03C 1/30; B03C 2201/00; B03C 2201/26; B03C 2201/28
USPC ..... 128/863
See application file for complete search history.

(56) References Cited

U.S. PATENT DOCUMENTS

| | | | | |
|---|---|---|---|---|
| 3,040,741 | A | 6/1962 | Carolan | |
| 3,056,402 | A | 10/1962 | Dickinson | |
| 3,079,917 | A | 3/1963 | Pate | |
| 3,092,105 | A | 6/1963 | Gabb | |
| 3,117,574 | A * | 1/1964 | Replogle | A62B 18/084 D24/110.4 |
| 3,234,939 | A | 2/1966 | Morton, Jr. | |
| 3,234,940 | A | 2/1966 | Morton, Jr. | |
| 3,347,229 | A | 10/1967 | Heitman | |
| 3,599,635 | A | 8/1971 | Ansite | |
| 3,599,636 | A * | 8/1971 | Gutman | A62B 18/084 128/207.11 |
| 3,850,168 | A | 11/1974 | Ferguson et al. | |
| 5,690,102 | A | 11/1997 | Bertheau et al. | |
| 6,039,045 | A | 3/2000 | Bertheau et al. | |
| 6,161,538 | A | 12/2000 | Bonhomme et al. | |
| 6,338,342 | B1 | 1/2002 | Fecteau et al. | |
| 6,497,232 | B2 | 12/2002 | Fecteau et al. | |
| 6,536,435 | B1 | 3/2003 | Fecteau et al. | |
| 8,505,536 | B2 | 8/2013 | Kielow et al. | |
| 2002/0078953 | A1 * | 6/2002 | Fecteau | A62B 18/084 128/207.11 |
| 2014/0216472 | A1 * | 8/2014 | Brace | A44B 11/2592 128/863 |
| 2016/0044994 | A1 * | 2/2016 | Soderberg | A43C 11/165 36/97 |
| 2016/0067441 | A1 | 3/2016 | Bearne et al. | |
| 2016/0361575 | A1 | 12/2016 | Gerson | |

FOREIGN PATENT DOCUMENTS

| | | | |
|---|---|---|---|
| EP | 2060294 | B1 | 7/2013 |
| FR | 2570579 | A1 * | 3/1986 |
| KR | 10-2017-0022385 | | 3/2017 |
| KR | 10-2018-0064284 | | 6/2018 |
| WO | WO13068343 | | 5/2013 |

* cited by examiner

RESPIRATOR

CROSS-REFERENCE TO RELATED APPLICATION

The present application is a continuation of International Application No. PCT/US2021/016182, filed on Feb. 2, 2021, which claims the benefit of and priority to U.S. Provisional Application No. 62/969,372, filed on Feb. 3, 2020, which are incorporated herein by reference in their entireties.

BACKGROUND OF THE INVENTION

The present disclosure relates to respirators that protect a user from breathing dust and other debris. The present disclosure relates to the rapid and reliable securing, attachment, adjustment, and release of a respirator to a user's face.

SUMMARY OF THE INVENTION

One embodiment of the invention relates to a respirator having a body, a set of straps with at least one of an upper strap and a lower strap, a handle, a gasket, an opening, a filter, and an exhaust valve. The upper and lower straps pass through a series of hooks on the body and handle to an anchor. The gasket is coupled to the body and facilitates the formation of a seal with a user's face forming internal airspace between the respirator and the user's face. The handle actuates between an unlocked position and a locked position that releases or secures the straps to the user's head. In the locked position, a seal forms between the gasket and the user's face. The filter is positioned within the body to restrict air from transiting into the opening without also transiting the filter. The exhaust valve is coupled to the body. Air is permitted to flow through the exhaust valve in a first direction, which exits the internal airspace.

Another embodiment of the invention relates to a quick-release respirator having one or more combination or composite straps. Combination straps have an elastic portion coupled to an inelastic portion (e.g., sewn together). When used with the respirator, combination straps enhance the locking and unlocking features of the respirator. For example, combination straps have an inelastic portion enmeshed or entwined between guides to an anchor on the mask and handle. An elastic portion secures the respirator to a user's face. In this configuration, strap lengths of the upper and lower straps remain relatively constant or equal as the straps are pulled/released by the locking mechanism. For example, the length of the upper strap tightened in the locking mechanism is approximately equal to the length of the tightened lower strap.

Another embodiment of the invention relates to a quick-release respirator with a housing that forms an internal airspace between the housing and the user's face. The housing has a guide and a post and is coupled to a gasket that forms the seal for the internal airspace. A filter is placed within the housing to restrict air from transiting into the internal airspace without also transiting the filter. Similarly, an exhaust valve is positioned on the housing to permits air to exit the internal airspace. To adjust or fasten the respirator, an actuator rotates about a pivot on the mask housing. The actuator has an anchor that rotates between an unlocked position and a locked position and adjusts the housing pressure. A loop is coupled to anchor and has an upper head strap, and a lower neck strap positioned to surround the back of the user's head or neck. A connector extends between the head strap and the neck strap through the guide to the post and returning from the post to couple to anchor on the actuator. The connector also extends from the anchor on the actuator to the neck strap.

Another embodiment of the invention relates to a quick-release respirator with a housing that forms an internal airspace between the housing and the user's face. The housing has a guide and a post and is coupled to a gasket that forms the seal for the internal airspace. A filter in the housing restricts air from transiting into the internal airspace without also transiting the filter. Similarly, an exhaust valve on the housing permits air to exit the internal airspace. An actuator has an anchor that rotates about a pivot on the housing. The actuator rotates between an unlocked position and a locked position. Upper and lower straps are positioned on the housing to surround the back of the user's head or neck. A connector strap interconnects and extends between the upper and lower straps. The connector strap has a first portion coupled to the upper strap and extends vertically downwards from the upper strap and along the housing to either the post or anchor. A second portion of the connector is coupled to the lower strap. The second portion extends from the lower strap vertically upwards along the housing to either the post or anchor. A middle portion of the connector is located between the first portion and the second portion. The middle portion of the connector is coupled to the anchor. The middle portion extends vertically either up or down to either the first or second portion of the connector located at the post.

Another embodiment of the invention relates to a quick-release respirator with a housing that forms an internal airspace between the housing and the user's face. The housing has a guide and a post and is coupled to a gasket that forms the seal of the internal airspace on the user's face. A filter in the housing restricts air from transiting into the internal airspace without also transiting the filter. Similarly, an exhaust valve on the housing permits air to exit the internal airspace. The user rotates an actuator about a pivot on the housing between an unlocked position and a locked position to adjust and fit the respirator. Upper and lower straps are positioned on housing to surround the back of the user's head or neck. A connector is coupled to an anchor on the actuator. The connector extends between the upper strap and the lower strap. The pivot is centrally located in a vertical direction on the housing between the post and the guide. In this configuration, the post is located vertically above or below the pivot on the housing.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a respirator are described. People commonly use respirators in environments with dirty or polluted air to clean air before being breathed in by a user. In general, the respirator designs discussed herein include a quick-release actuator, latch, or handle pivotably coupled to the body of the respirator and entwining the connector or cord of the upper and lower straps. The handle defines restraint points or hooks near the pivot and an anchor opposite the pivot near the pivoting end of the handle. As the handle pivots, a length of the cord entwined by the guides changes. For example, in a locked position, the handle is rotated to increase the amount of the cord entwined in the handle. The cord pulls on the upper and lower straps and decreases the strap length and the elastic upper and lower straps stretch to tightly hold the respirator on/against the user's face. In an unlocked position, the handle rotates to a second position that decreases the amount of the cord entwined in the handle and provides an increased length of cord to the upper and lower straps. The increased length of cord reduces the tension in the upper and lower straps and facilitates the adjustment, fit, or removal of the respirator from the user's face.

Applicant has found that this configuration forms a quick adjustment to form a gas-tight seal against a user's face. Since the user can more quickly fit the respirator, this feature is advantageous for workers to don and doff the respirator quickly. In addition, the mask enhances user compliance because the user can reliably and securely fasten and/or adjust the mask for comfortability and the particular needs of the end-user.

In some embodiments, combination or composite straps have both an inelastic region and elastic region to enhance comfort and the quick-connect feature. For example, elastic straps couple to inelastic cords to form the composite strap. The inelastic cord is entwined in the handle, and the elastic straps extend around and engage the user's head and/or neck. Specifically, the inelastic region is entwined within the grommets, hooks, and/or anchors on the handle or the mask. The elastic region is stretched to secure the mask around the user's head. The latch enhances the length of the loosened strap available to the user to adjust the strap before fitting and securing the mask. For example, the inelastic region has less flexibility and does not stretch. Therefore, when this area of the cord is entwined in the locked position, it pulls on the elastic region to secure the fit of the mask on the user's head. Similarly, when the inelastic area is released from the locked position into the unlocked position, the adjusted position enables it to contribute substantially the same length of cord as the change in the arc. Thus strap adjustments are only made in a region that benefits the user and does not interfere with the locking mechanism or handle.

Figure 1:
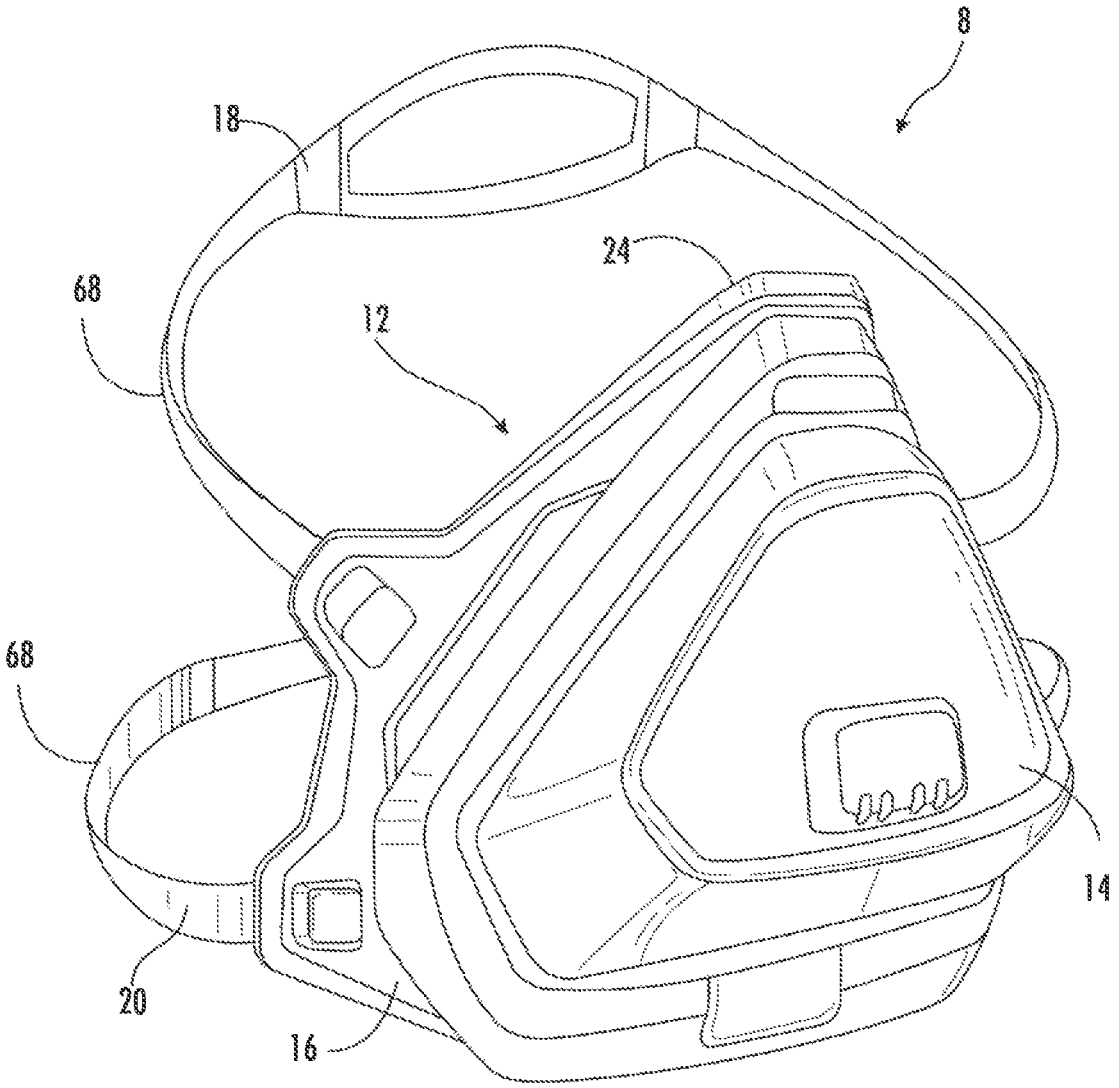
FIG. 1 is a perspective view of a respirator, according to an exemplary embodiment.
Figure 2:
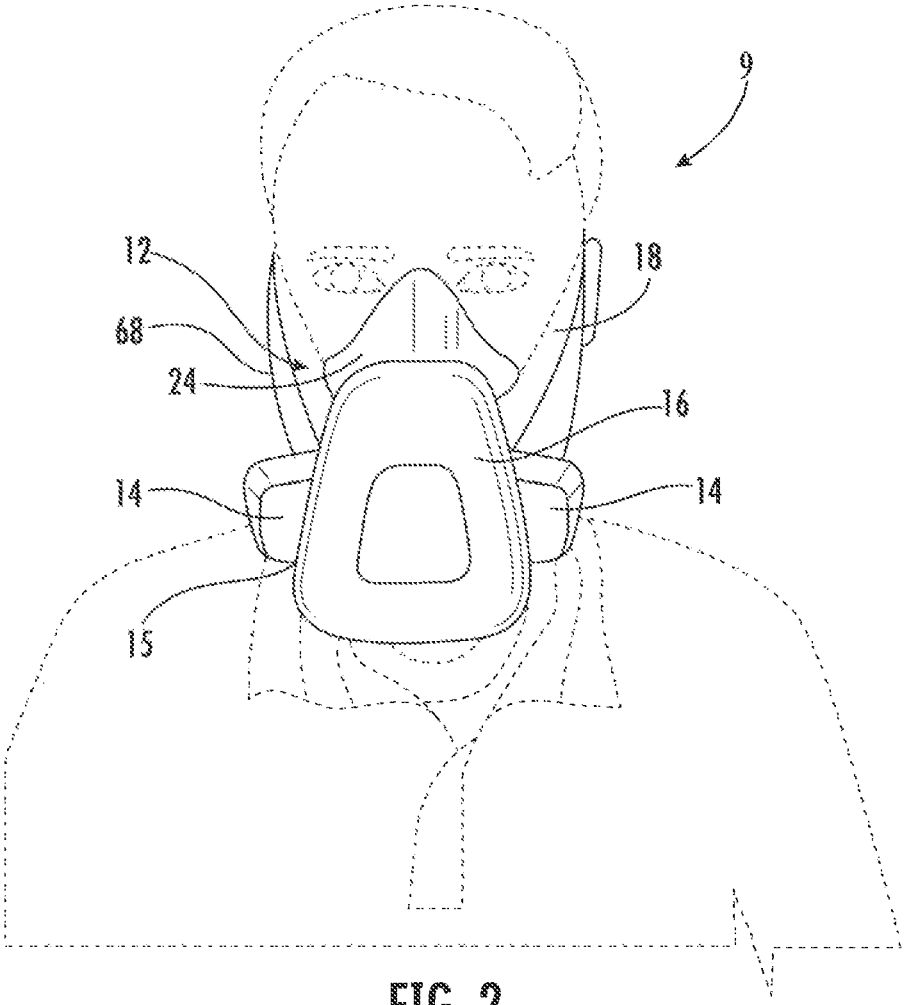
FIG. 2 is a perspective view of a respirator with upper and lower straps fitted to the head of a user, according to another embodiment of the invention.

FIG. 1 is an assembled perspective view of a respirator 8, and FIG. 2 shows a user wearing a respirator 9. As shown in FIGS. 1 and 2, both types of respirators (e.g., respirator 8 and/or 9) includes a mask 12 with a separate filter 14, which allows replacement of filter 14 without replacing mask 12. An exhaust valve 15 is also disposed or positioned on mask 12. Exhaust valve 15 is located either adjacent to filter 14 or elsewhere on mask 12. Mask 12 includes a body that couples to a gasket to form a housing 16 having a generally triangular profile. Mask 12 and/or housing 16 form an internal airspace between housing 16 and a user's face when respirator 9 is worn. As used herein, directions such as vertically upward or downward refer to general directions along mask 12 while being worn on the user's face in the upright position.

For example, the top of mask 12 forms a top point of the triangular profile to seal the user's nose, and the base of the triangular profile at the bottom of mask 12 seals the user's mouth. An upper strap 18 or head strap and a neck strap or lower strap 20 are positioned on mask 12. Upper strap 18 and lower strap 20 surround the back of the user's head or neck and support respirator 8 and/or 9 on the user's face. For example, a user adjusts upper strap 18 and/or lower strap 20 to secure and fit mask 12 on the user's head. As will be described in greater detail below, in some embodiments, upper strap 18 and/or lower strap 20 include an elastic cord 68, band, and/or composite elastic material (e.g., combination or composite strap 70). The elasticity (e.g., increased deflection or strain) of elastic cords 68 and/or composite strap 70 assists the user to don, doff, or adjust the respirator 10 and provides pressure on mask 12 to hold respirator 10 against the user's face. Elastic cord 68 and/or composite strap 70 in upper strap 18 and/or lower strap 20 provide flexibility in the unlocked position while also ensuring a snug and secure fit of mask 12 on the user's face in the locked position.

Figure 3:
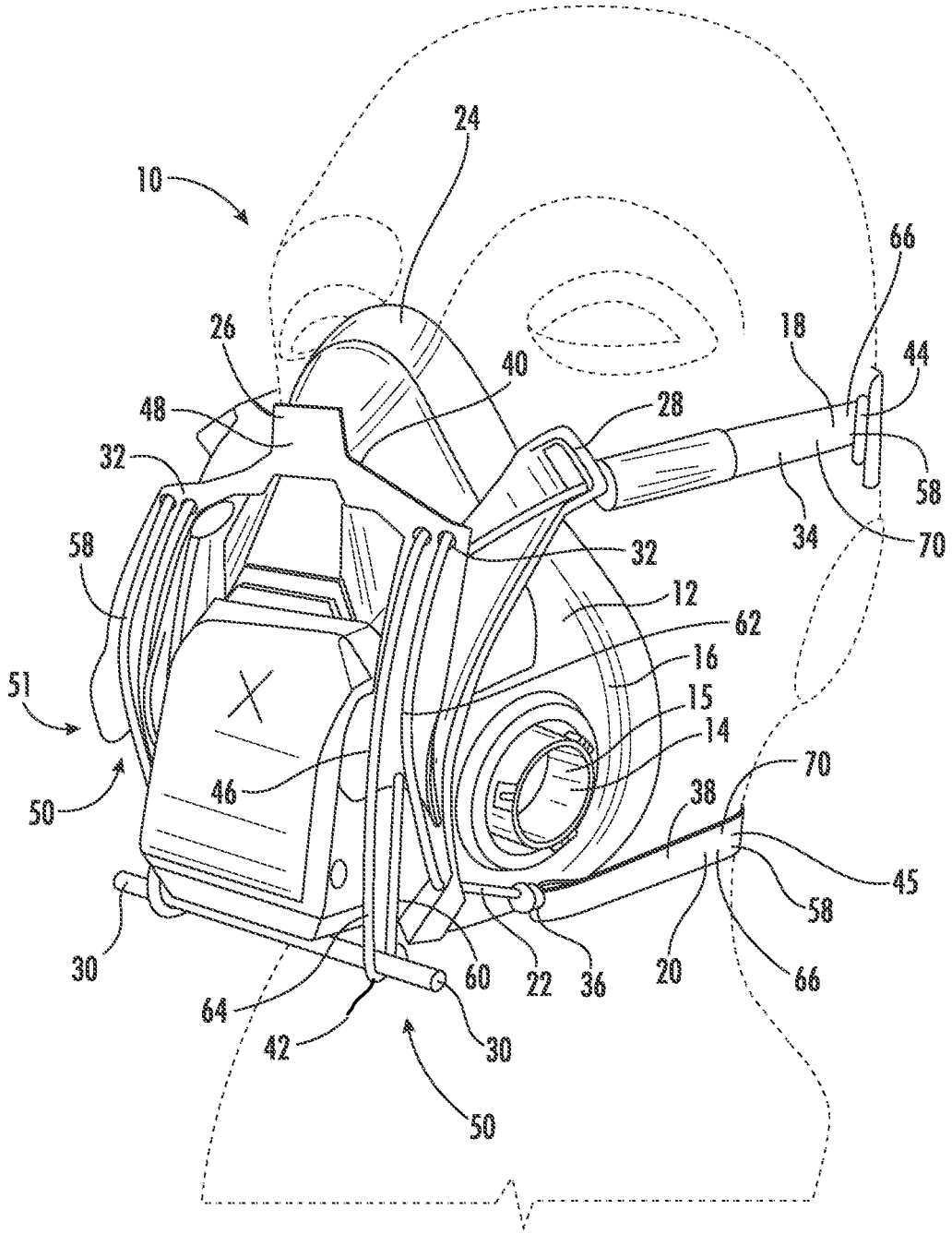
FIG. 3 is a perspective view of a respirator showing the cord and the upper and lower straps, according to another exemplary embodiment.

FIG. 3 is a perspective view of respirator 10 according to an exemplary embodiment. Respirator 10 is substantially similar to respirators 8 and 9 discussed above, which the differences discussed herein. Respirator 10 includes a support strap, including an upper strap 18 and lower strap 20 fitted to the head/neck of a user and a connector or cord 22 that couples to the ends and interconnects upper and lower straps 18 and 20. The connector, shown as cord 22, couples upper strap 18 to lower strap 22. In the absence of cord 22, e.g., in a continuous strap or loop, connector is the inelastic portion that is enmeshed in mask 12 and connects upper strap 18 to lower strap 20 (e.g., is located between straps 18 and 20 on the loop). FIGS. 3 and 8-11 show a doubled over joint 36 where cord 22 couples to a doubled over elastic lower strap 20 that captures an end of cord 22.

Respirator 10 includes a quick-release mechanism that includes an actuator to increase or decrease the tension on the upper and lower straps 18 and 20. Similar to the respirator of FIG. 2, respirator 10 includes a mask 12 and filters 14 on either side. Mask 12 and/or housing 16 is coupled to the user's head with an upper strap 18 and lower strap 20 to secure respirator 10 and form a gas-tight or hermetic seal. In the embodiment shown, mask 12 is coupled to a flexible/elastic upper strap 18 and a flexible/elastic lower strap 20.

As shown in FIG. 3, upper strap 18 and/or lower strap 20 couple to a connector, shown as an inelastic strap or cord 22. Cord 22 is relatively inelastic compared to elastic cord 68 and/or composite strap 70 that can be used to form upper strap 18 and/or lower strap 20. Accordingly, under equal load, cord 22 deflects less (e.g., has a lower strain) than elastic cord 68 and/or composite strap 70, used in upper strap 18 and/or lower strap 20. Cord 22 is entwined through a series of guides and couples to an end of upper cord 18 and an end of lower cord 20. Cord 22 extends between upper strap 18 and lower strap 20. The position of cord 22 between upper strap 18 and lower strap 20 acts as a connector on mask 12 that interconnects upper strap 18 to lower strap 20. Cord 22 extends through guides on mask 12 from an end of upper strap 18 extending about the head to an end of the lower strap 20 extending about the neck.

In various embodiments, cord 22 has three portions. Specifically, a first or upper portion 60 that is coupled to upper strap 18. Upper portion 60 is defined as the portion of cord 22 that extends from upper strap 18 (e.g., joint 36) vertically downwards along housing 16 on mask 12 to returning hook 30 (e.g., from upper strap 18 to returning hook 30). In another embodiment, upper portion 60 extends vertically upwards and couples to anchor 32.

Similarly, in various embodiments, a lower portion 62 of cord 22 extends vertically upwards along housing 16 to returning hook 30 or anchor 32. For example, lower portion 62 is defined as the part of cord 22 extending between lower strap 20 to either returning hook 30 or anchor 32. A middle portion 64 of cord 22 is located between upper portion 60 and lower portion 62. Middle portion 64 is defined from anchor 32 to either upper portion 60 or lower portion 62 at returning hook 30. Stated differently, middle portion 64 extends vertically from anchor 32 up or down to returning hook 30.

As described in greater detail below, upper strap 18 and lower strap 20 extend about a periphery of housing 16 to secure respirator 10 against the user's head. When upper strap 18 and/or lower strap 20 are coupled to cord 22, the inelastic properties of cord 22 (e.g., reduced strain) combine with the elastic properties of upper strap 18 and/or lower strap 20 (e.g., increased strain) to enhance the ergonomic fit of the quick-connect respirator 10. Cord 22 (e.g., of upper strap 18 and/or lower strap 20) is entwined, such that cord 22 passes through guides, holes, and/or grommets within the locking mechanism and/or mask 12 to secure respirator 10 on the user's head. Straps 18 and 20 are flexible to permit user adjustment on the user's face.

In various embodiments, upper strap 18 and/or lower strap 20 comprise an elastic and/or flexible material to accommodate variations in user's head sizes and shapes. Straps 18 and 20 couple to cord 22 to form a support strap or loop 58. Loop 58 has an elastic upper strap 18 and/or lower strap 20 that is coupled to an inelastic cord 22 to provide areas with elastic and inelastic properties in loop 58. For example, an integral upper strap 18 has an elastic region (e.g., strap 18) with an inelastic region (e.g., cord 22). As another example, upper strap 18 is elastic and couples to an inelastic cord 22 to form the inelastic region. In some embodiments, cord 22, upper strap 18, and lower strap 20 combine to form a continuous loop 58. For example, a continuous loop 58 does not have any joints 36 or discontinuities. In this embodiment, there are no joints 36 at the anchors and/or between cord 22 and upper strap 18 and lower strap 20. In other embodiments, loop 58 and/or cord 22 is discontinuous. For example, cord 22 is discontinuous at anchor 32 such that the cord 22 coupled to upper strap 18 is discontinuous from the cord 22 coupled to lower strap 20.

Respirator 10 includes a gasket 24 disposed on the same side of housing 16 from which upper strap 18 and/or lower strap 20 extend. Gasket 24 couples to housing 16 to form a mask 12 that seals of the internal airspace against the user's face. In some embodiments, gasket 24 extends along the perimeter of housing 16. When respirator 10 is secured and/or fastened, upper and/or lower straps 18 and 20 pull on mask 12, so that gasket 24 forms a seal around the user's mouth and nose to filter inhaled air.

Respirator 10 includes an actuator or handle, shown as latch 26. In general, latch 26 rotates about a pivot relative to housing 16 between a locked state in which respirator 10 is secured to a user's face and an unlocked position in which respirator 10 is disengaged allowing it to be doffed. In addition, respirator 10 includes various guides, grommets, collars, and/or restraints, shown as eyelets 28, that entwine cord 22 between upper strap 18 and lower strap 20. As used herein, entwined refers to the portion of cord 22 that passes through a series of guides. Cord 22 of upper strap 18 refers to the portion of cord 22 between anchor 32 and the upper strap 18, and cord 22 of lower strap 20 refers to the portion of cord 22 between anchor 32 and the lower strap 20. Cords 22 of upper and lower straps 18 and 20 re entwined because cords 22 are threaded through eyelets 28 of mask 12 and/or latch 26. Eyelets 28 are secured to mask 12 and/or latch 26. At specific locations on mask 12, eyelets 28, or returning hooks 30, bend and return cord 22 (or upper strap 18 and/or lower strap 20) to reverse a direction of cord 22 about returning hook 30. Cord 22 returns or bends around returning hooks 30 to change direction. Specifically, returning hooks 30 bend cord 22 so that it doubles back or turns approximately 180° onto itself. In various embodiments, upper and lower straps 18 and 20 end at cord 22 that extends from upper and lower straps 18 and 20 to couple to anchor 32.

Cord 22 extends between upper and lower straps 18 and 20 to form loop 58. Specifically, cord 22 extends from upper strap 18 through the guides (e.g., eyelets 28) down to a post, shown as returning hook 30, where it reverses direction and returns from returning hook 30 and is coupled to anchor 32 on latch 26. Cord 22 also extends from anchor 32 on latch 26 to lower strap 20. In this configuration, rotation of latch 26 increases/decreases the length of cord 22 (and upper/lower straps 18 and 20) to don, doff, or adjust respirator 10.

In some embodiments, an elastic upper band 34 couples to cord 22 at joint 36 before coupling to anchor 32. For example, upper band 34 couples to cord 22 at joint 36 and cord 22 couples to anchor 32. In other words, upper strap 18 includes loop 58 formed by a composite of an elastic band 34 and cord 22. This configuration is called a composite upper strap 18 or a composite strap 70. In various embodiments, composite strap 70 has an elastic sheath 66 surrounding an inelastic cord 22, or elastic and inelastic fibers are selected and woven into cord 22 to produce the desired elasticity of composite strap 70. In this way, a single loop can be continuous, having an inelastic cord 22 woven into a composite strap 70 to produce less strain at cord 22 than at upper or lower upper strap 18 and/or lower strap 20.

Similarly, a lower elastic band 38 can couple to cord 22 at joint 36 before coupling to anchor 32 to form a composite lower strap 20 configuration. In addition, elastic upper band 34 can couple to cord 22, which then couples to lower elastic band 38. This configuration forms a composite strap 70 for a loop 58 with an elastic upper strap 20 with elastic band 34 and an elastic lower strap 20 with elastic band 38. In various embodiments, cord 22 is continuous at anchor 32, but cord 22 can also be discontinuous. For purposes of this application, upper strap 18 refers to a section of a strap used to secure mask 12 against a back of a user's head or a part of a user's head above the lower strap 20, and lower strap 20 refers to the section of a strap used to secure mask 12 against the lower part of a user's head or neck.

Latch 26 mates or fits within with a recess 40 of housing 16 to secure latch 26, upper strap 18 and/or lower strap 20 in a closed or locked position, e.g., as shown in FIGS. 3, 4, 7-9, and/or 14. In some embodiments, filter 14 has a substantially similar profile as housing 16 (FIG. 1-2) and is coupled to housing 16 of respirator 10. In other embodiments, filter 14 is attached to mask 12 and/or housing 16 and is a separate or detachable component of respirator 10. In general, filter 14 is located on or within housing 16 to restrict air from transiting into the internal airspace of housing 16 without also transiting through filter 14. Exhaust valve 15 is also coupled to housing 16 to permit exhaled air to exit the internal airspace.

To don and/or secure respirator 10, a user first positions mask 12 against their head in an unlocked position. Gasket 24 is positioned against the user's face to seal the internal airspace adjacent to the user's nose and mouth. The seal defines and creates the filtered internal airspace between the user's face and mask 12. Upper strap 18 and lower strap 20 are freely positioned around the back of the user's head or neck as desired in the unlocked position. When the user pulls on latch 26 to rotate anchor 32 from the unlocked position into the locked position, upper strap 18 and lower strap 20 are tightened, and pull cord 22 through the entwining guides, eyelets 28, and returning hook 30. Anchor 32 rotates to tighten upper strap 18 and lower strap 20 and ensure gasket 24 creates a tight seal against the user's face. To remove and/or adjust the respirator 10, the user simply reverses the process. Specifically, when the user rotates latch 26 from the locked position to the unlocked position, cord 22 is loosened in the entwined region of eyelets 28, returning hook 30, and anchor 32.

Latch 26 rotates about a pivot 46 on housing 16 between an unlocked position and a locked position to don and doff the respirator 10. Upper strap 18 and/or lower strap 20 are adjustable and repositionable to provide user comfort while compressing gasket 24 on the user's face. Latch 26, entwined cord 22, and straps 18 and 20 form a quick-connect seal that creates a gas-tight seal on the user's face. The seal prevents debris ingress from reaching the internal airspace or being inhaled through the mouth or nose.

In various embodiments, the locations of eyelet 28, pivot 46, and returning hook 30 define the leverage on latch 26. Arranging the locations of the guides (e.g., eyelet 28, returning hook 30, and/or anchor 32) on mask 12 changes the leverage of anchor 32 to pull/release cord 22 and loosen/tighten upper strap 18 and lower strap 20. For example, in one embodiment, pivot 46 and returning hook 30 are co-axial. In other embodiments, returning hook 30 is either above or below pivot 46 in a vertical direction of mask 12, e.g., while being worn.

As shown in the embodiment of FIG. 3, eyelet 28 is located above pivot 46 and returning hook 30 on housing 16. Pivot 46 is positioned between latch 26 and housing 16. In one embodiment, pivot 46 is centrally located on mask 12 in a vertical direction, and anchor 32 is located on a locking end 48 of latch 26. Pivot 46 is between returning hook 30 and eyelet 28 and returning hook 30 is located vertically opposite eyelet 28 above or below pivot 46 on housing 16. Locking end 48 is located between pivot 46 and a bottom of mask 12 and/or housing 16 in the locked position. Returning hook 30 is nearer the bottom of mask 12 than anchor 32. For example, in the locked position returning hook 30 is located below pivot 46, and locking end 48 is between pivot 46 and returning hook 30. Applicant has found that placing eyelet 28 near a top edge of mask 12 and return hook 30 on the opposite vertical side (e.g., near or offset below the bottom or bottom edge) increases the leverage of latch 26.

Figure 4:
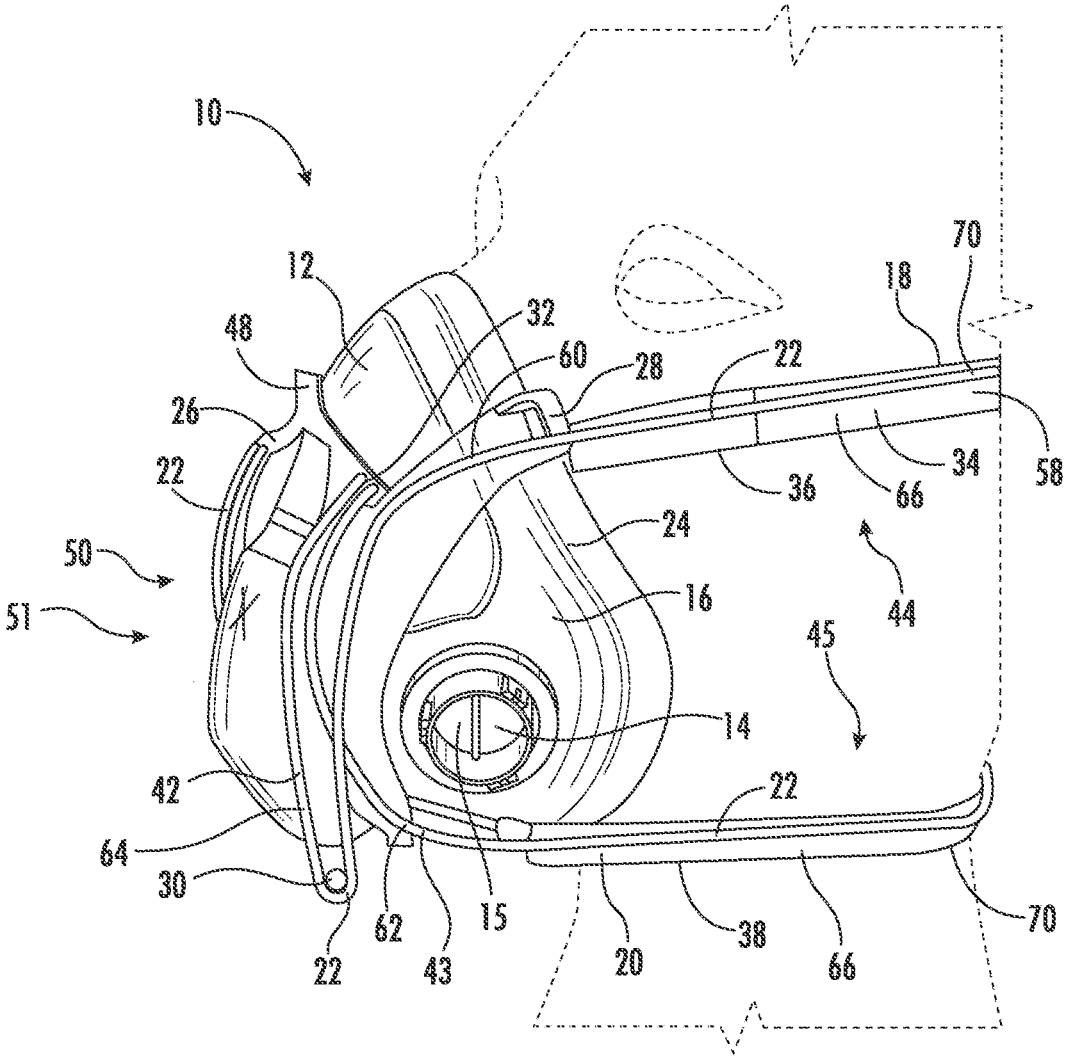
FIG. 4 is a side view of the respirator of FIG. 3 showing the cord and the upper and lower straps in a locked position, according to an exemplary embodiment.
Figure 5:
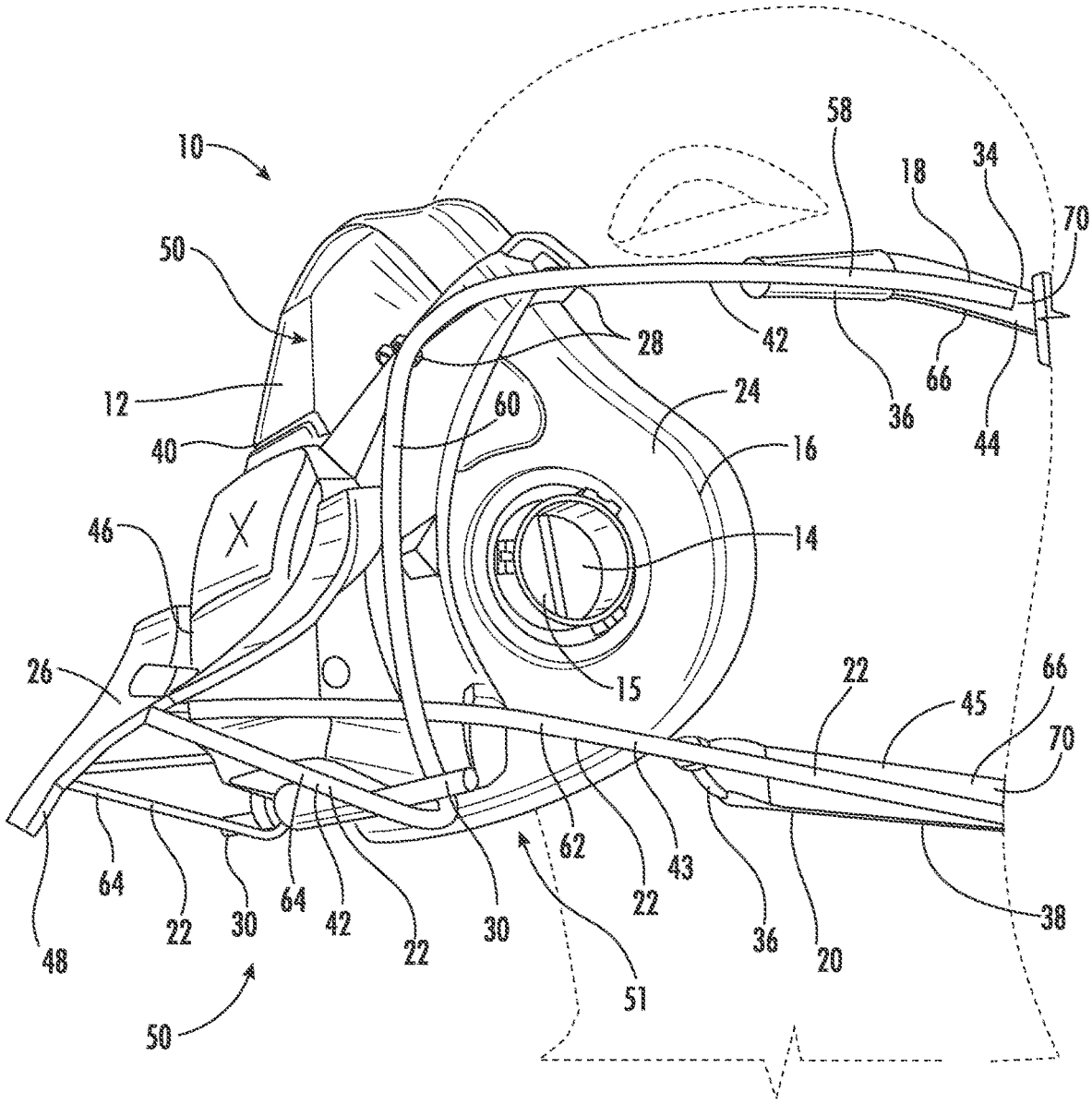
FIG. 5 is a perspective view of the respirator of FIG. 3 showing the cord and the upper and lower straps in an unlocked position, according to an exemplary embodiment.

FIGS. 4 and 5 shown an alternative embodiment for respirator 10 in which upper and lower straps 18 and 20 have a sheath 66 surrounding cord 22. In various embodiments, sheath 66 is elastic or inelastic and creates an elastic region 44 when it surrounds cord 22. For example, an inelastic sheath 66 covers and surrounds cord 22 in elastic region 44 to facilitate deflection of straps 18 and 20 surrounding cord 22. Cord 22 extends around upper and lower straps 18 and 20 in the elastic region 44 and sheath 66 couples to joint 36, where cord 22 is exposed and extends, e.g., without an exterior sheath 66, through the inelastic region 42. FIGS. 4 and 5 show upper strap 18 and lower strap 20 in a locked position (FIG. 4) and an unlocked position (FIG. 5). In the locked position, the user releases anchor 32 by pivoting latch 26. As latch 26 rotates, anchor 32 rotate, the length of cord 22 available to extend lengths of straps 18 and 20 increases from the closed or locked position of FIG. 4 to an open or unlocked position of FIG. 5. As shown in FIG. 4, upper strap 18 and/or lower strap 20 are composite straps having a sheath 66 over cord 22 to form an inelastic region 42 and elastic region 44. For example, inelastic cord 22 is exposed in the inelastic region 42 and sheath 66 has an elastic material in the elastic region 44. In some embodiments, cord 22 is an inelastic material with a sewn joint 36 that couples to an elastic material 44 (e.g., sheath 66 or an elastic cord 68). For example, upper strap 18 and lower strap 20 are each sewn to cord 22.

FIG. 4 shows respirator 10 including a composite upper strap 18 and a composite lower strap 20. For example, upper strap 18 has an inelastic region 42 and an elastic region 44. Similarly, lower strap 20 has an inelastic region 43 and an elastic region 45. As shown in FIG. 4, inelastic regions 42 and 43 are entwined in eyelets 28 of mask 12 and/or latch 26 and are secured at anchor 32. For example, anchor 32 is located on the end of latch 26 opposite pivot 46. Elastic regions 44 and 45 provide for adjustment with the user's head to enhance ergonomic fit and comfort. Applicant has found that using composite straps 70 for upper strap 18 and lower strap 20 enhances user compliance by improving the ergonomic design of respirator 10 while maintaining the gas-tight seal formed with the user's face.

FIGS. 4 and 5 show eyelet 28 and anchor 32 placement and connections with upper strap 18 and lower strap 20. As shown, cords 22 of both upper strap 18 and lower strap 20 pass through eyelet 28 near a pivot 46 of latch 26 and terminate at an anchor 32 at a locking end 48 of latch 26. This enables the shortening of both upper strap 18 and lower strap 20 by rotating latch 26 in the same direction about pivot 46 (e.g., rotating cord 22 by rotating latch 26 clockwise about pivot 46, as shown in FIG. 5). In this configuration, both upper and lower straps 18 and 20 are shortened by the same amount as latch 26 moves from the unlocked position (FIG. 5) to the locked position (FIG. 4). Similarly, because the embodiment of FIGS. 4 and 5 include composite straps 70 for upper strap 18 and lower strap 20 with inelastic regions 42 entwined in latch 26 when latch moves from a locked position to an unlocked position (e.g., from FIG. 4 to FIG. 5) the lengths of upper strap 18 and lower strap 20 increases substantially the same amount.

In contrast, if upper strap 18 and lower strap 20 were designed to only include elastic regions 44, the increased length of the straps in the unlocked position may not be the same. For example, some of the elastic regions 44 stretch unequally in response to the cord 22 in the guides of various entwined regions 50. Entwined region 50 is the distance or length that cord 22 engages eyelets 28 and/or anchors 32 on mask 12. In the embodiment of FIGS. 4 and 5, entwined region 50 on cord 22 of upper strap 18 is double entwined region 51 on cord 22 of lower strap 20. In this configuration, the force that stretches an elastic upper strap 18 is approximately two times (e.g., twice or more) the force that stretches an elastic lower strap 20. In other words, part of the released length of cord 22 will "unstretch" or release the elastic tension on elastic strap 18 or 20 when latch 26 moves from the locked position of FIG. 4 to the unlocked position of FIG. 5.

Specifically, when elastic straps are used in entwined regions 50 and 51, the strain on upper strap 18 is not the same as the strain on lower strap 20. The different deflections mean the released length of upper strap 18 is not the same as the released length of lower strap 20. When straps 18 and 20 are released, unequal lengths of upper strap 18 and lower strap 20 will be released by rotation of latch 26 from the locked position to the unlocked position. Applicant has found that by using elastic in sheath 66 and/or composite straps 70 for upper and lower straps 18 and 20 with an inelastic region 42 for cord 22 in the entwined region 50 of mask 12, the released length of straps 18 and 20 by rotating latch 26 about pivot 46 is substantially the same or equal.

In one embodiment, entwined region 50 extends between eyelet 28 on housing 16 and anchor 32 on latch 26. Cord 22 length measured between eyelet 28 and returning hook 30 and returning to anchor 32 is more than twice the length of cord 22 between lower strap 20 and anchor 32. For example, the length of cord 22 between eyelet 28 and returning hook 30 and returning to anchor 32 is more than twice the length of upper strap 18 and/or lower strap 20. In various embodiments, upper and lower upper strap 18 and/or lower strap 20 include an elastic member such as composite strap 70 and/or upper and lower elastic bands 34 and/or 38. This configuration ensures a strain of upper strap 18 and a strain of lower strap 20 is greater than a strain of cord 22 when loop 58 is stretched, for example, by latch 26 to don, doff, or otherwise adjust respirator 10.

As shown in FIGS. 4 and 5, upper strap 18 extends through a plurality of guides (e.g., first, second, and/or third) to wrap down to returning hook 30, where it doubles back to anchor 32 at locking end 48 of latch 26. Lower strap 20 couples to eyelets 28 and anchor 32 directly without doubling back through returning hook 30. This orientation can be reversed, as described with reference to FIGS. 14-17 below. When the orientation of latch 26 is reversed, locking end 48 is nearer the bottom of mask 12, and pivot 46 rotates in the opposite direction. Lower strap 20 wraps upwards through a plurality of guides (e.g., first, second, and/or third) to a returning hook 30, where it doubles back to anchor 32 at the end of latch 26 (e.g., at or near locking end 48). In this orientation, upper strap 18 couples to eyelets 28 and anchor 32 directly without doubling back through a returning eyelet 28.

Figure 6:
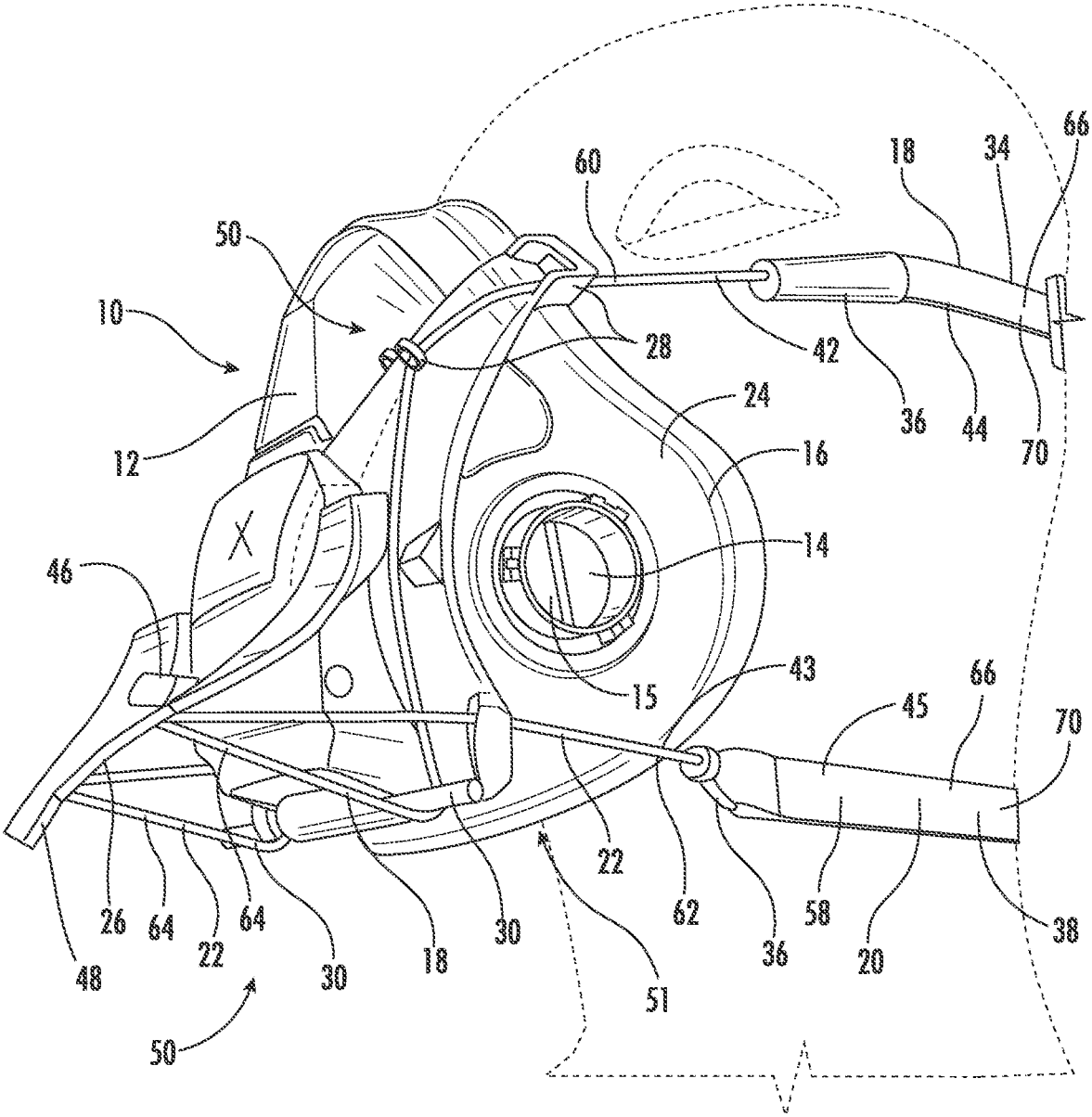
FIG. 6 is a perspective side view of a respirator showing the cord and the upper and lower straps in an unlocked position, according to another exemplary embodiment.

FIGS. 6-7 and 12-13 show an alternative embodiment for respirator 10 in which lower strap 20 includes a hook and loop joint 36 that couples cord 22 to elastic region 44. FIG. 6 is a perspective side view of the upper and lower straps in an unlocked position. In this view, inelastic region 43 and/or cord 22 of lower strap 20 is shown extending from a joint 36 through eyelet 28 and directly to anchor 32. In contrast, inelastic region 42 and/or cord 22 of upper strap 18 extends from joint 36 through first and second eyelets 28. Returning hook 30 orients cord 22 of upper strap 18 in substantially the same direction as cord 22 of lower strap 20 relative to anchor 32. As shown in FIG. 6, cord 22 of upper strap 18 doubles-back or returns at returning hook 30 and couples to anchor 32. In some embodiments, cord 22 of upper strap 18 and/or lower strap 20 terminates or ends at anchor 32. For example, cord 22 is discontinuous between cord 22 of upper strap 18 and cord 22 of lower strap 20. In other embodiments, cord 22 of upper strap 18 and lower strap 20 is continuous such that cord 22, upper strap 18, and/or lower strap 20 comprise the same continuous integral strap or loop 58, which extends through anchor 32. The head part of such a strap (e.g., upper strap 18) is named differently than the neck part of the strap (e.g., lower strap 20) and/or cord 22 based on the location relative to anchor 32 and the user's head or neck.

Figure 7:
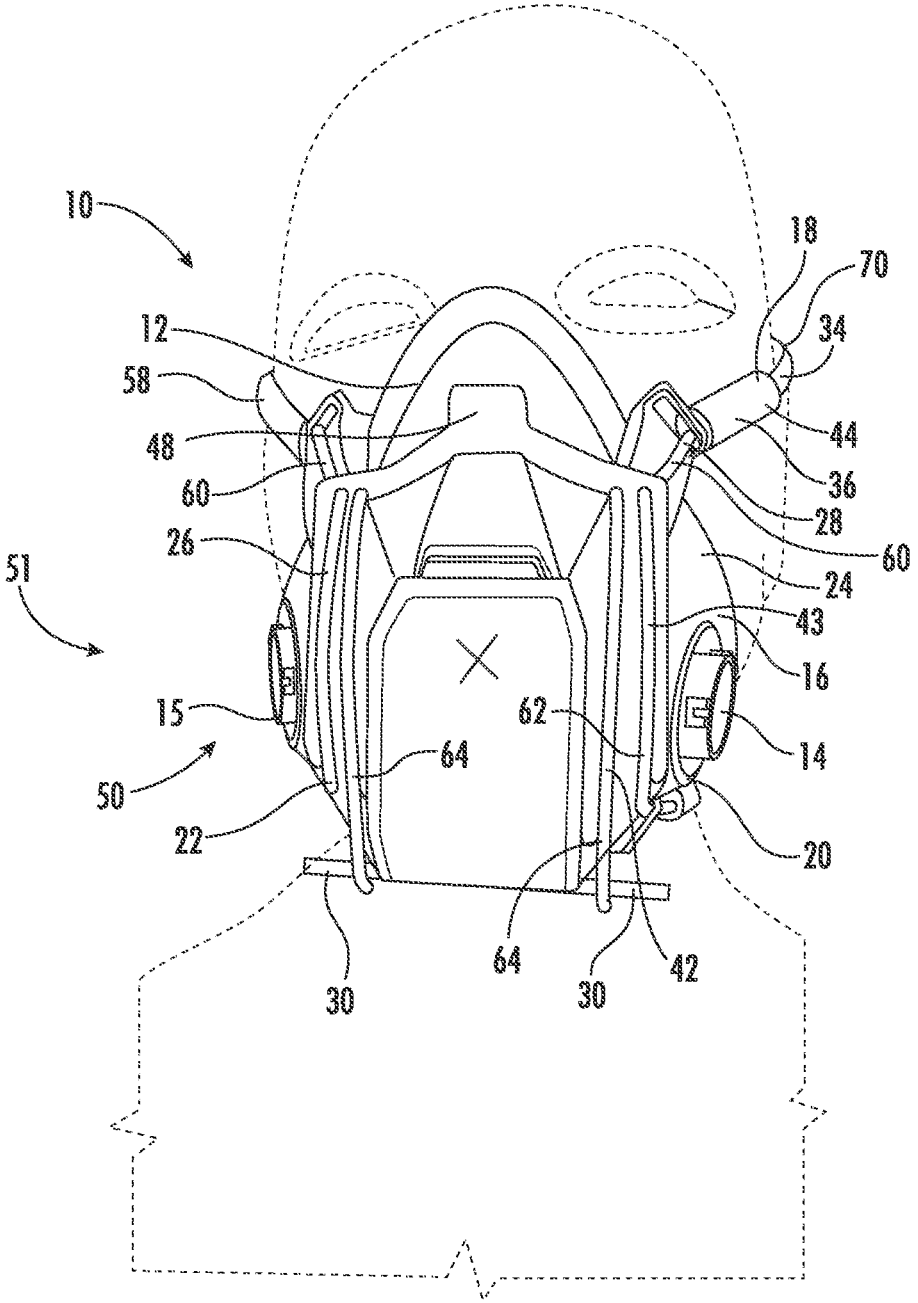
FIG. 7 is a front view of the respirator of FIG. 6 showing the cord and the upper and lower straps in a locked position, according to an exemplary embodiment.
Figure 8:
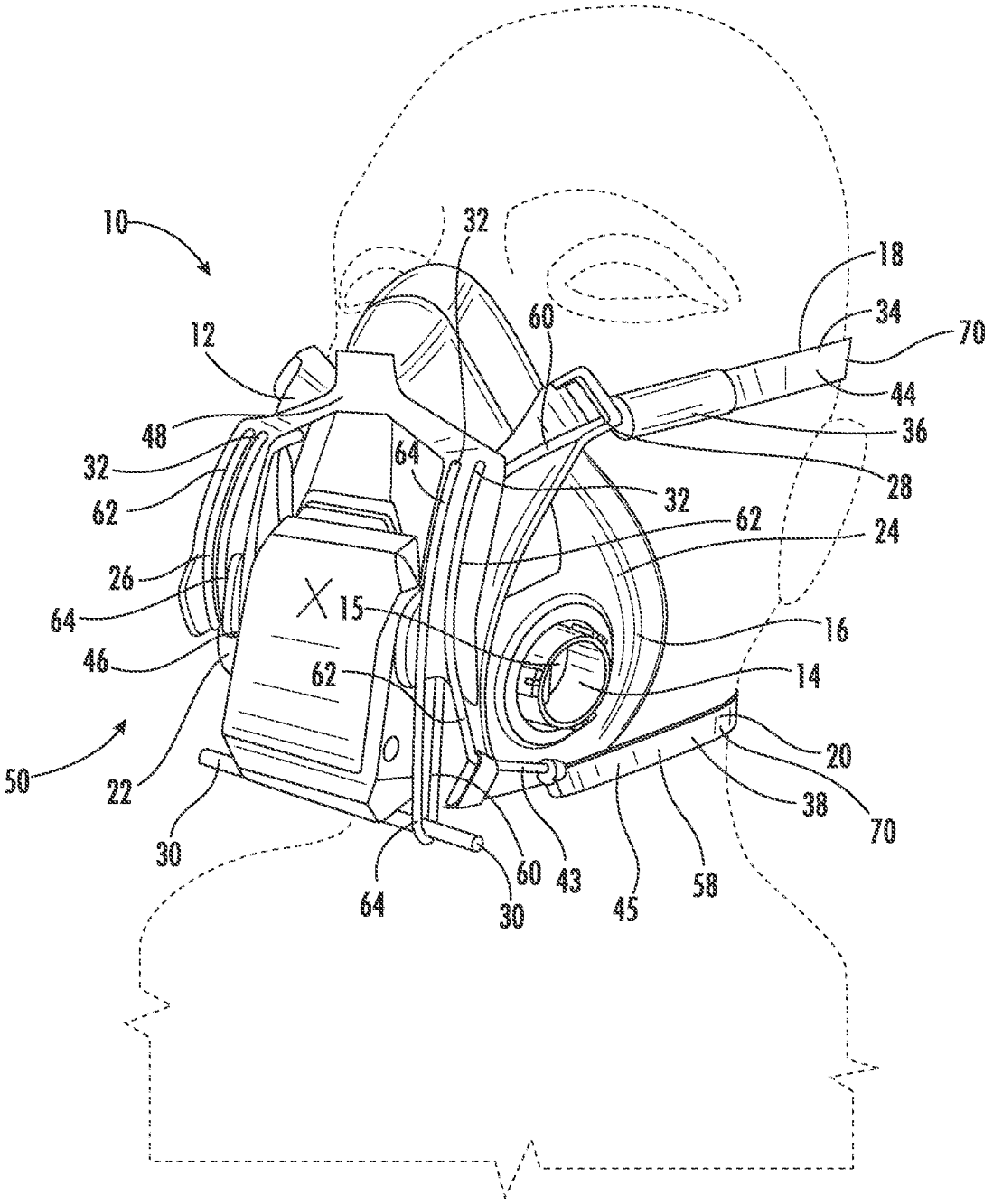
FIG. 8 is a perspective side view of the respirator of FIG. 6 showing the cord and the upper and lower straps in a locked position, according to an exemplary embodiment.
Figure 9:
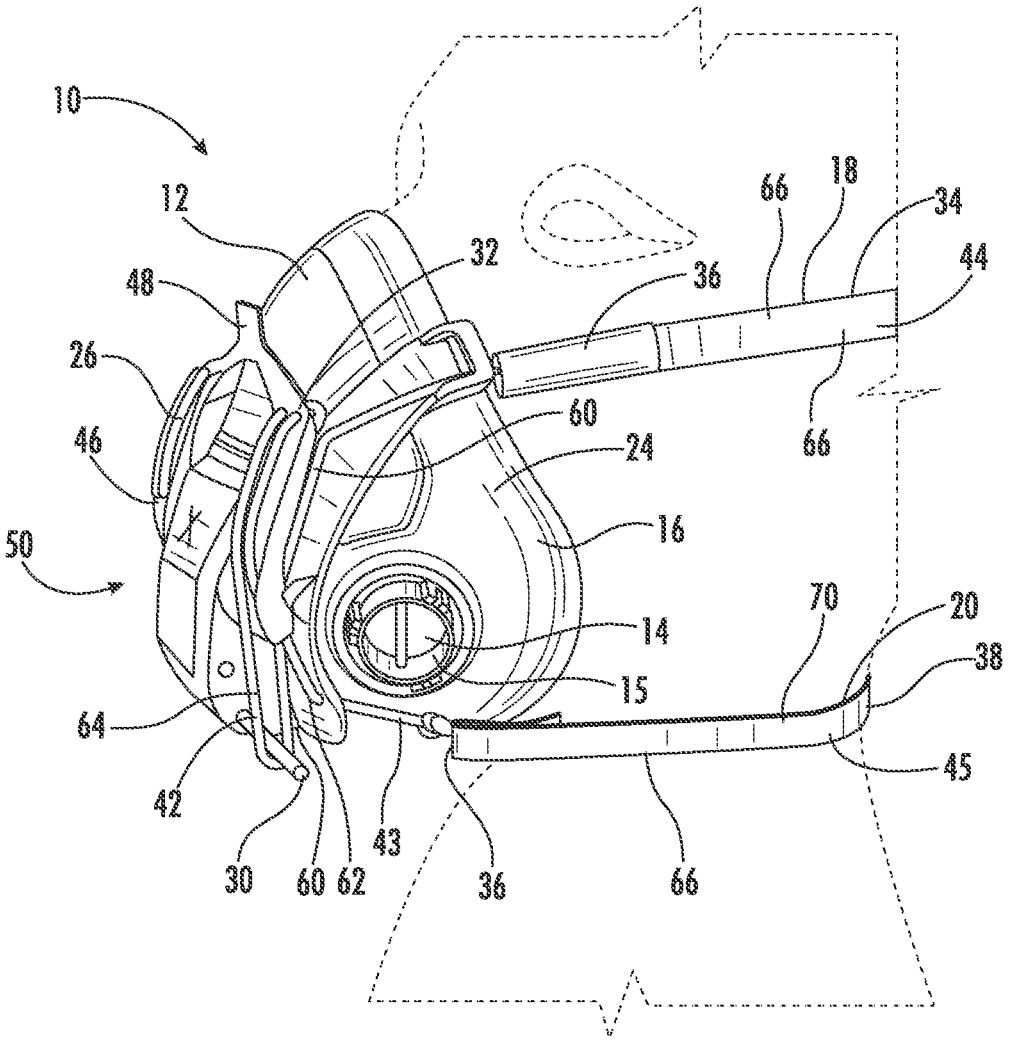
FIG. 9 is a perspective side view of the respirator of FIG. 6 showing the cord and the upper and lower straps in a locked position, according to an exemplary embodiment.

FIGS. 7-9 show various front and side perspective views of upper strap 18 and lower strap 20 in a locked position. In this configuration, lower strap 20 is shown in a doubled over or doubled back configuration to receive cord 22 at joint 36 and transition from inelastic region 42 to elastic region 44. Cord 22 couples to upper strap 18 and lower strap 20 to form loop 58. In other words, cord 22 does not terminate at anchor 32 but is continuous. In addition, cord 22 is relatively inelastic. Releasing latch 26 from the locked position results in approximately equal lengths of inelastic cord 22. The equal lengths of released cord 22 are distributed to elastic regions 44 of upper elastic band 34 and lower elastic band 38 (e.g., upper strap 18 and lower strap 20). Various configurations join upper elastic band 34 and/or lower elastic band 38 to cord 22. Specifically, joint 36 is sewn, stitched, glued with an adhesive, coupled at a sheath 66, melted and bonded, welded (e.g., spot welded), brazed, soldered, or fastened. For example, a clip or buckle couples bands 34 and/or 38 to cord 22.

Figure 10:
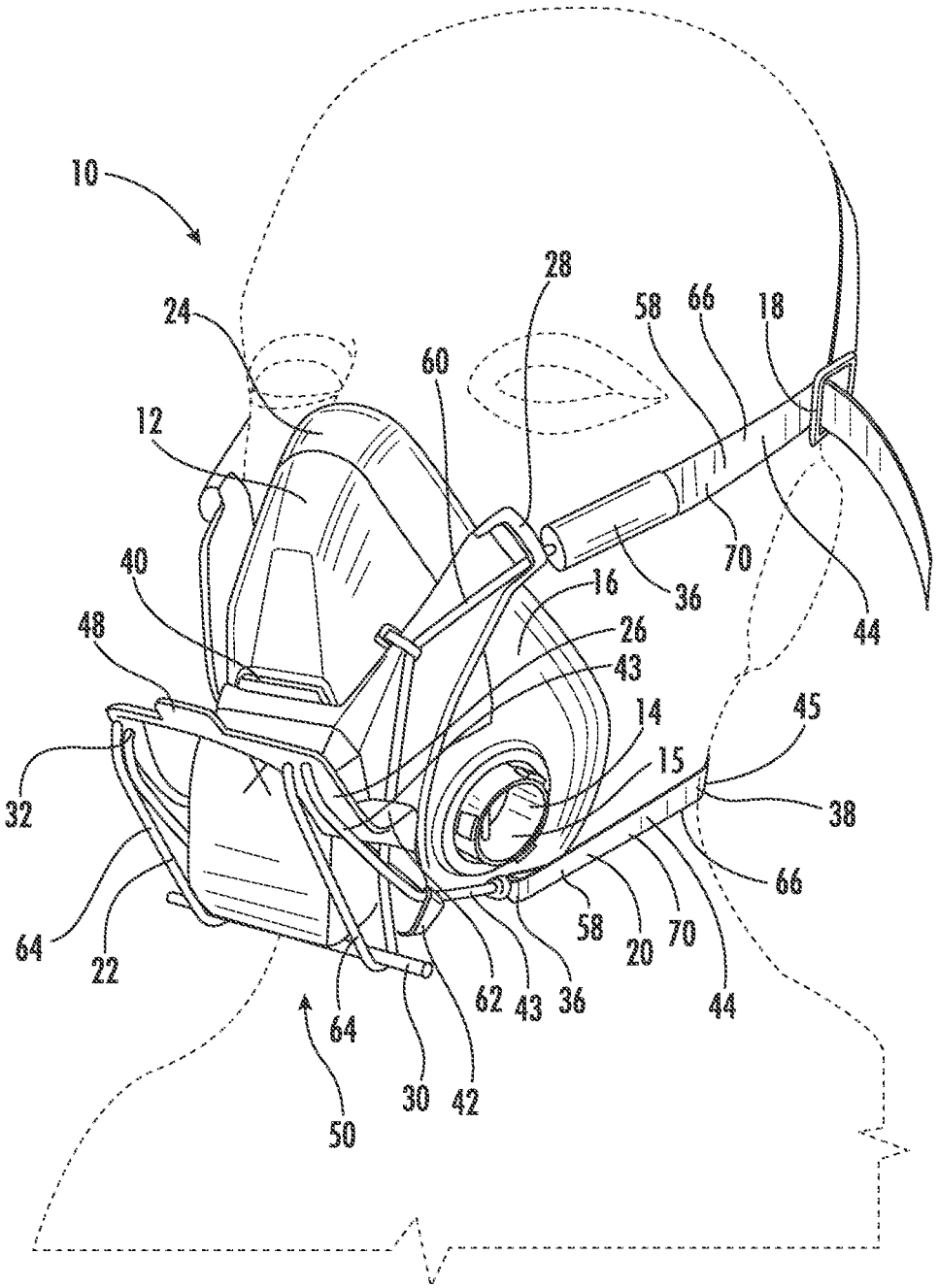
FIG. 10 is a perspective view of the respirator of FIG. 6 showing the cord and the upper and lower straps in transition between a locked position and an unlocked position, according to an exemplary embodiment.
Figure 11:
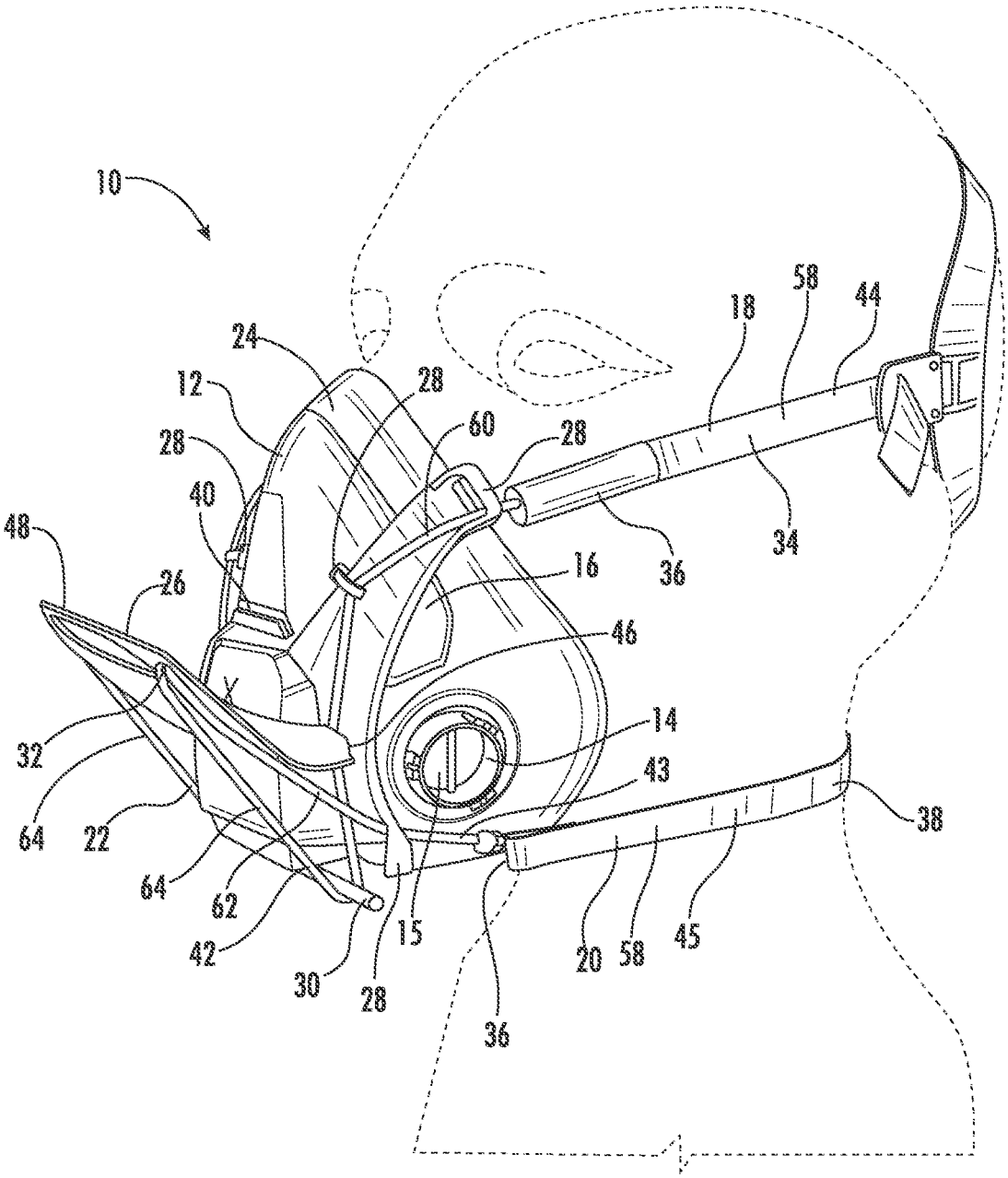
FIG. 11 is a perspective side view of the respirator of FIG. 6 showing the cord and the upper and lower straps in transition between a locked position and an unlocked position, according to an exemplary embodiment.

FIGS. 10 and 11 show various side views of the upper strap 18 and lower strap 20 in a transition between a locked position and an unlocked position. Lower strap 20 is shown in the doubled back configuration to receive an end of cord 22. For example, the transition between the locked position of FIG. 4 and the unlocked position of FIG. 5 is shown in FIGS. 10 and 11. FIGS. 10 and 11 show the process of locking latch 26 (e.g., from the unlocked position of FIG. 5 to the locked position of FIG. 4). By changing the arc of rotation, FIGS. 10 and 11 also show the process of releasing mask 12. For example, by rotating latch 26 from the locked position of FIG. 4 to the unlocked position of FIG. 5. As shown, cord 22 of upper strap 18 passes through two eyelets 28, one returning hook 30, and terminates at anchor 32. In contrast, cord 22 of lower strap 20 passes through one eyelet 28 and directly to anchor 32. In this way, cord 22 of upper strap 18 has an entwined region that is approximately twice as long as the entwined region or length of cord 22 for lower strap 20. FIGS. 10 and 11 also show a detent or recess 40 configured to receive latch 26 and securely store and/or lock latch 26 to housing 16 of mask 12.

Figure 12:
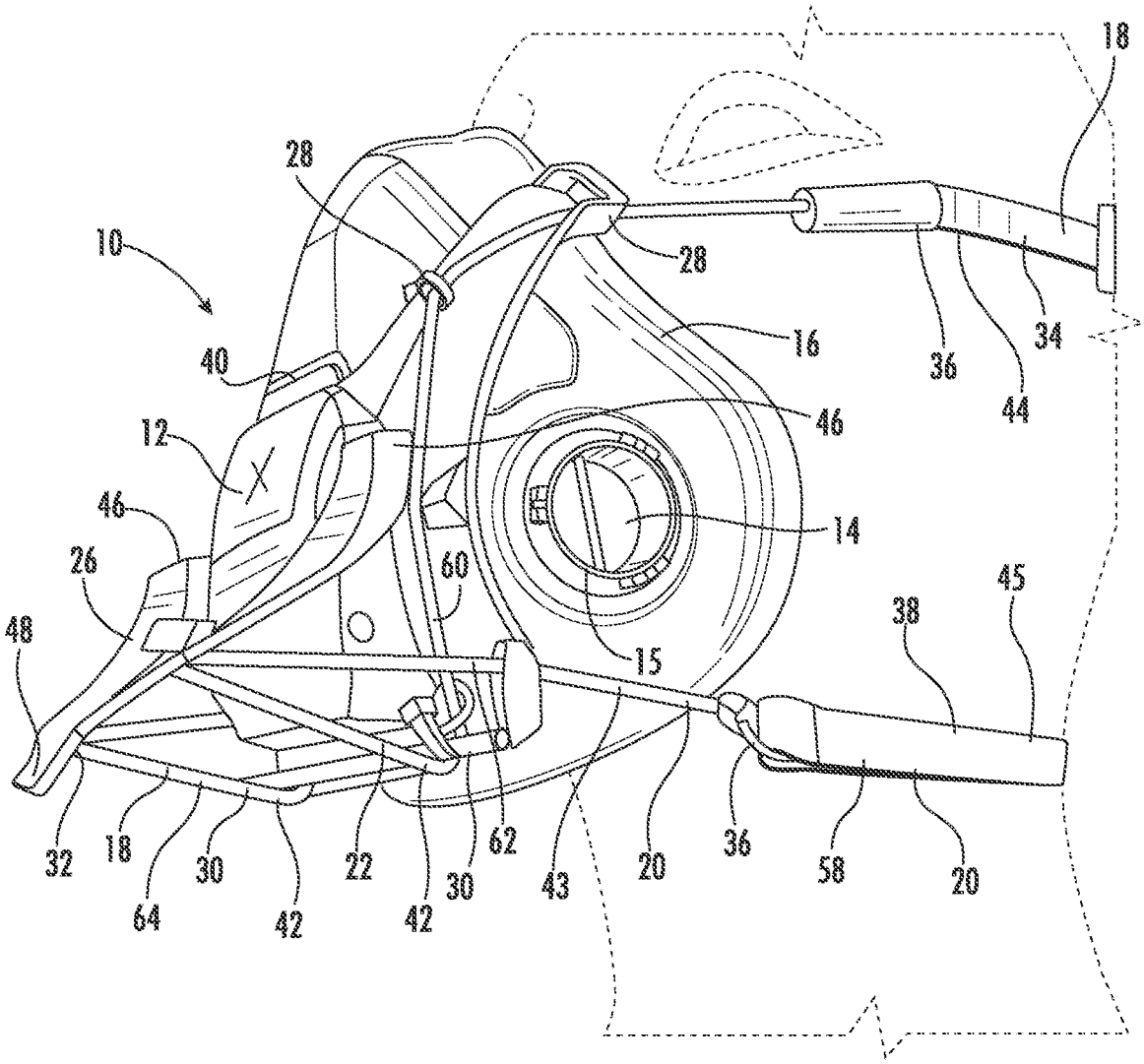
FIG. 12 is a perspective view of the respirator of FIG. 6 showing the cord and the upper and lower straps in an unlocked position, according to an exemplary embodiment.
Figure 13:
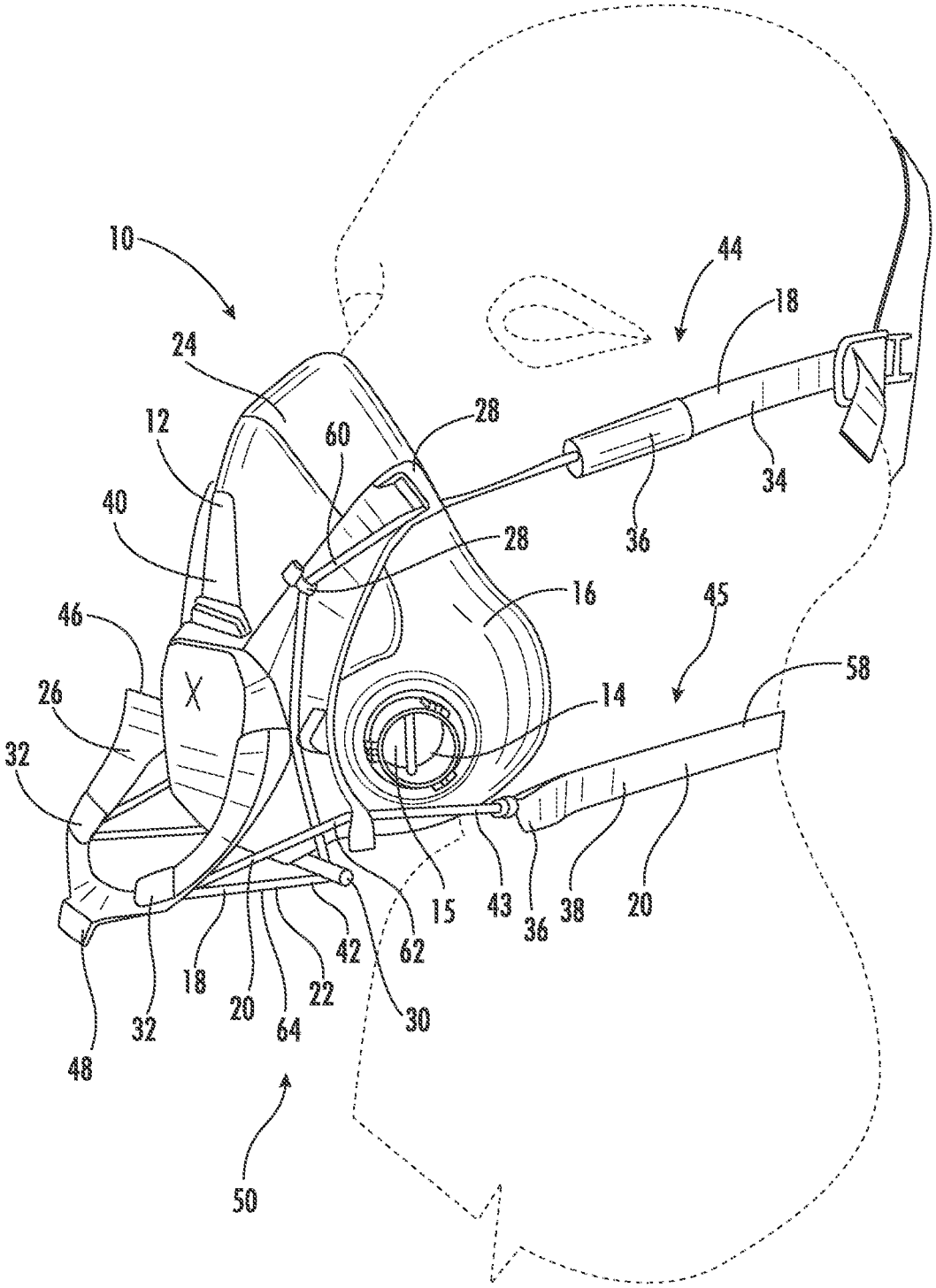
FIG. 13 is a perspective view of the respirator of FIG. 6 showing the cord and the upper and lower straps in an unlocked position, according to an exemplary embodiment.

FIGS. 12 and 13 show various side views of upper strap 18 and lower strap 20 in an unlocked position. This perspective illustrates a hook and loop joint 36. Specifically, cord 22 couples to (e.g., is tied around) a hook at the end of upper and/or lower strap 18 and/or 20. When locking end 48 of latch 26 travels from the locked position (e.g., FIG. 4) to the unlocked position (FIG. 5), approximately equal lengths of cord 22 are released because cord 22 is inelastic and anchor 32 travels through the same arc from upper strap 18 and lower strap 20. FIGS. 12 and 13 show upper strap 18 passing through a first eyelet 28 near a top (e.g., nose edge) of mask 12, a second more centrally located eyelet 28 (e.g., between nose and mouth), and around returning hook 30 located near or below the bottom edge before returning to couple to anchor 32. In contrast, lower strap 20 passes through only one eyelet 28 on mask 12 before coupling to anchor 32 on latch 26.

In various embodiments, eyelets 28 are located on latch 26 to retain upper strap 18 and/or lower strap 20 on latch 26 as it moves from an unlocked position to a locked position. For example, the arc shape (e.g., curvature radius and/or length) of latch 26 changes the locking mechanism's kinematics. In other words, the arc shape determines the length of cord 22 tightened or released during the locking/unlocking process.

Figure 14:
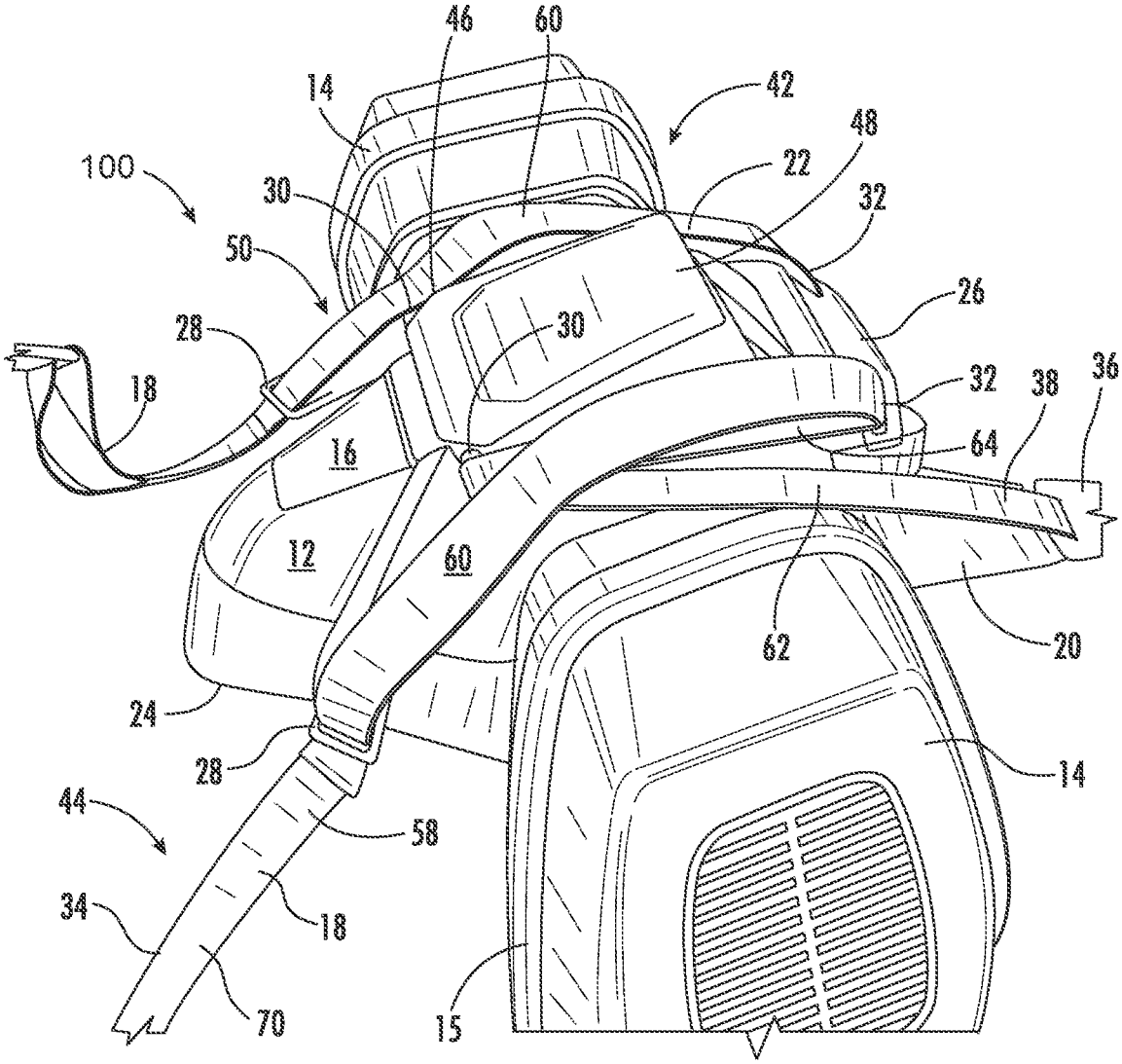
FIG. 14 is a perspective view of a respirator with filters attached showing an alternative orientation of the cord and the upper strap and lower strap in the locked position, according to an exemplary embodiment.
Figure 15:
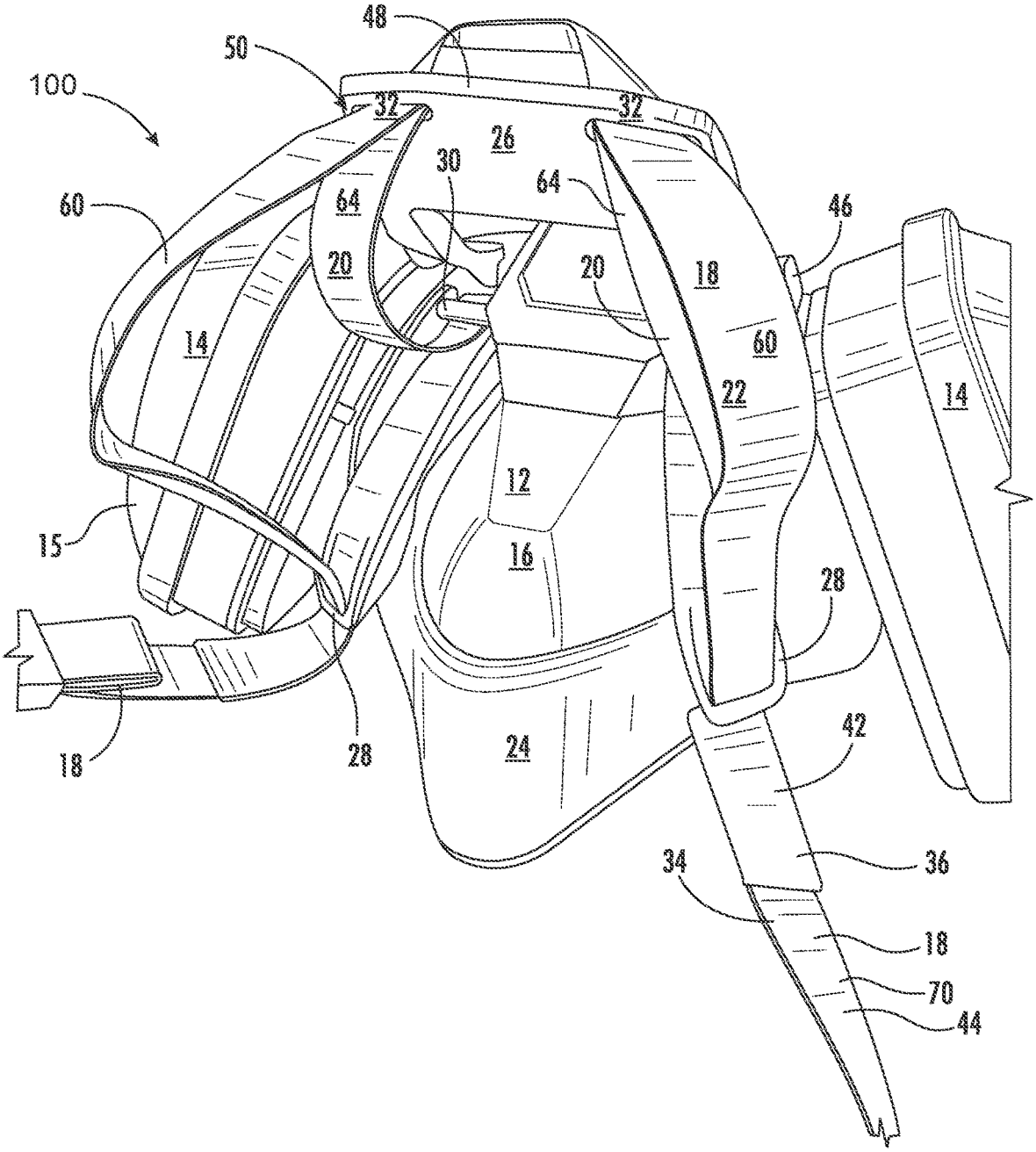
FIG. 15 is a top perspective view of the respirator of FIG. 14 showing the cord and the upper and lower straps in an unlocked position, according to an exemplary embodiment.
Figure 16:
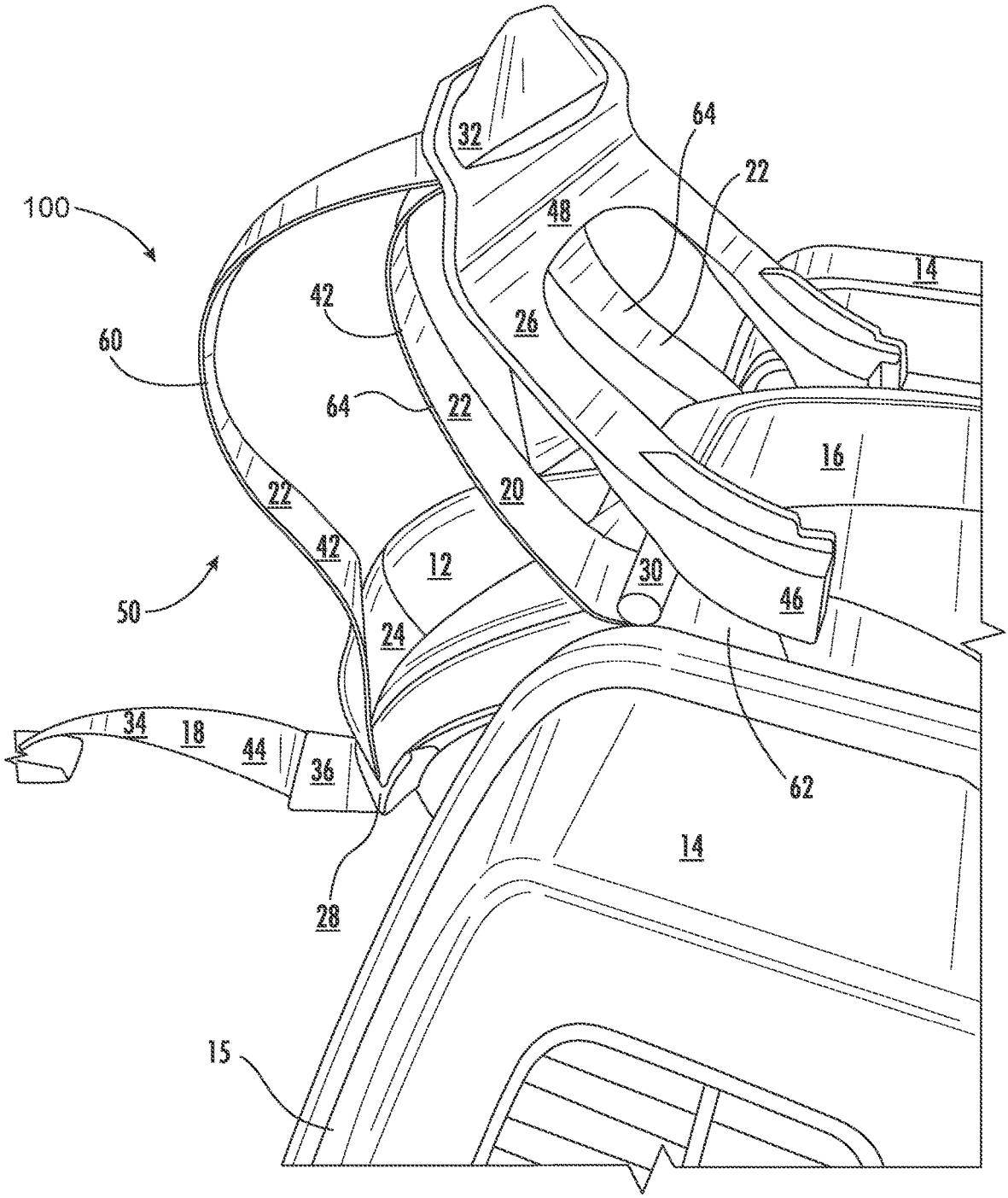
FIG. 16 is a perspective view of the respirator of FIG. 14 showing the cord and the upper and lower straps in an unlocked position, according to an exemplary embodiment.
Figure 17:
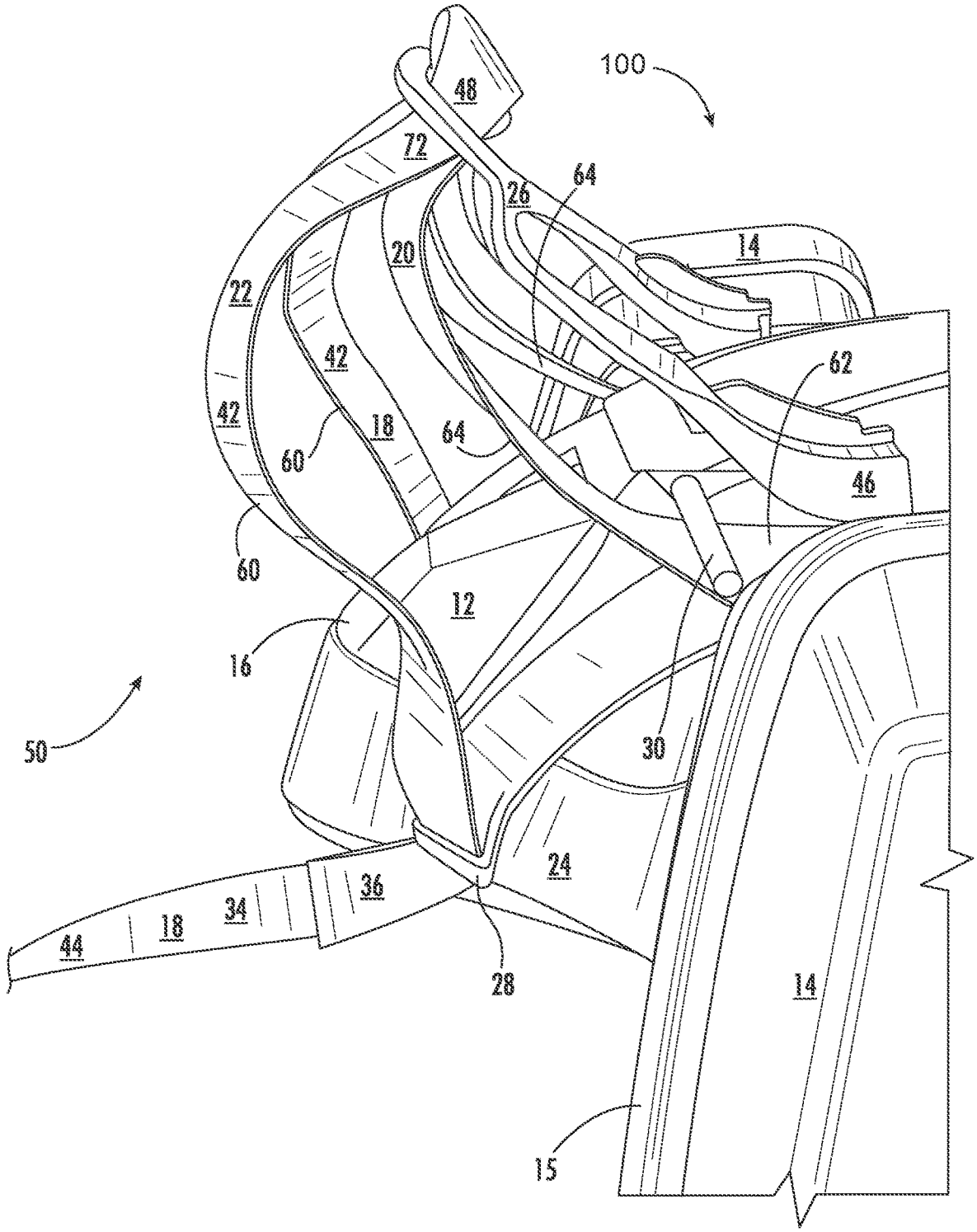
FIG. 17 is a perspective view of the respirator of FIG. 14 showing the cord and the upper and lower straps in an unlocked position, according to an exemplary embodiment.

FIG. 14 is a front-side perspective view of another respirator 100 with filters attached showing alternative hook and anchor locations so that the orientations of the upper strap 18 and lower strap 18 in the locked position are opposite the embodiment shown in FIG. 4. FIG. 15 is a top perspective view and FIGS. 16 and 17 are side perspective views of respirator 100 of FIG. 14 in an unlocked position.

The respirator 100 shown in FIGS. 14-17 is substantially the same as the embodiment of respirator 10 shown in FIGS. 3-13, except for the differences described. In contrast to respirator 10 of FIGS. 3-13, respirator 100 of FIGS. 14-17 has a revised orientation for upper strap 18 and lower strap 20. Specifically, the embodiment of FIGS. 14-17, respirator 100 has latch 26 with a locking end 48 that is nearer a bottom (e.g., mouth) of mask 12 and pivot 46 is centrally located in a vertical direction, e.g., nearer the nose. Pivot 46 rotates in the opposite direction of the latch 26 of respirator 10. For example, a user would lift on latch 26 near the mouth of mask 12 to unlock a secured respirator 100. Similarly, the user would pull down on latch 26 to secure latch 26 in a recess 40 near a mouth of mask 12 to lock the upper strap 18 and lower strap 20.

Because of the reversed orientation on respirator 100 compared to respirator 10, the location of eyelets 28, returning hook 30, pivot 46, and/or locking end 48 are different in the embodiment of FIGS. 14-17. For example, the embodiments shown in FIGS. 3-13 show a respirator 10 with returning hook 30 located below pivot 46 and locking end 48 of latch 26 in the locking position. In the locked configuration, upper portion 60 of cord 22 extends from upper strap 18 to returning hook 30 along a front surface of housing 16. Middle portion 64 of cord 22 extends from anchor 32 to the upper portion 60 located at returning hook 30. Lower portion 62 of cord 22 extends from lower strap 20 to anchor 32. Pivot 46 is centrally located along a vertical direction of mask 12. Returning hook 30 is located on mask 12 near the bottom of housing 16, and locking end 48 of latch 26 is positioned nearer the top of mask 12 between pivot 46 and eyelet 28 in the locked position. (FIGS. 4 and 7-9).

The embodiments of respirator 100 shown in FIGS. 14-17, a reverse configuration with returning hook 30 located above pivot 46. Lower portion 62 of cord 22 extends from lower strap 20 vertically upwards (e.g., from mouth to nose on mask 12) to returning hook 30. Middle portion 64 of cord 22 extends from returning hook 30 to anchor 32. Upper portion 60 of cord 22 extends vertically downward from upper strap 18 to anchor 32. In this configuration, pivot 46 is centrally located along a vertical direction of mask 12, and returning hook 30 is located nearer a top (e.g., over the nose) of housing 16. Locking end 48 of latch 26 is position nearer the bottom of mask 12, below both pivot 46 and returning hook 30 in the locked position. (FIG. 14).

In the configuration of respirator 100 shown in FIG. 14, lower strap 20 wraps up to returning hook 30, where it doubles back to anchor 32 at the end of latch 26 at or near locking end 48. In this orientation, upper strap 18 couples to eyelets 28 and anchor 32 directly without doubling back through a returning eyelet 28. In this configuration, the length of entwined cord 22 coupled to lower strap 20 is at least twice the length of entwined cord 22 coupled to upper strap 18. Stated differently, a length of cord 22 extending between anchor 32 and the lower strap is at least twice a length of cord 22 extending between anchor 32 and the upper strap. In some embodiments, upper strap 18 passes through one eyelet 28 and couples directly to anchor 32. Lower strap 20 passes through two eyelets 28 and a returning hook 30 before coupling to anchor 32. Similar to the embodiments described above, upper strap 18 and/or lower strap 20 use elastic regions 42 and inelastic regions 44 to enhance the reliability and fit of respirator 100. Thus, mask 12 has entwined region 50 with inelastic cord 22, such that when latch 26 is released, approximately equal lengths of cord 22 are released for each upper strap 18 and lower strap 20. Similarly, tightening or locking latch 26 reduces substantially equal lengths of upper strap 18 and lower strap 20.

The respirator of FIGS. 14-17 also shows a different kind of elastic upper band 34 and lower band 38 coupled to a sewn joint 36. An elastic member is positioned inside an inelastic sheath 66 and has elastic bands 34 and/or 38 to increase the strain of straps 18 and 20. For example, a material from the outer sheath 66 is sewn into joint 36 to couple with cord 22. FIGS. 14-17 show a continuous loop 58 of an integral/continuous strap that forms upper strap 18 and lower strap 20 and cord 22 while retaining both inelastic 42 at cord 22 and elastic regions 44 at upper strap 18 and lower strap 20. In this way, an integral strap/loop 58 has inelastic meshed regions 50 and 51 while retaining elastic regions in the upper strap 18 and lower strap 20 for an enhanced ergonomic design that facilitates the user to don, doff, and/or otherwise adjust the fit of respirator 100.

As used herein, entwined region, section, or area refers to the part of a cord or strap that passes through a series of guides, such as an eyelet or grommet. The entwined region includes the length of cord from the guide to the anchor for that section of cord or strap.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths, and radii, as shown in the Figures, are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A quick-release respirator, comprising:

a housing configured to form an internal airspace between the housing and a user's face, the housing comprising a guide and a post;

a gasket coupled to the housing that forms a seal of the internal airspace;

a filter coupled to the housing that restricts air from transiting into the internal airspace of the housing without also transiting the filter;

an actuator that rotates about a pivot relative to the housing between an unlocked position and a locked position, the actuator comprising an anchor;

an upper strap configured to be positioned to surround a back of a user's head, the upper strap coupled to the actuator;

a lower strap configured to be positioned to surround the back of the user's head or neck, the lower strap coupled to the actuator; and a connector strap extending between the upper strap and the lower strap;

wherein the post is positioned along an edge of the housing and is centrally located in a horizontal direction on the housing, the post comprising:

a first end configured to engage a first portion of the connector strap; and a second end of the post opposite the first end, the second end configured to engage a second portion of the connector strap.

2. The quick-release respirator of claim 1, further comprising:

an exhaust valve coupled to the housing that permits air to exit the internal airspace; and wherein the first portion of the connector strap is coupled to the upper strap and extending vertically downwards along the housing to either the post or the anchor;

wherein the second portion of the connector strap is coupled to the lower strap and extends vertically upwards along the housing to either the post or the anchor; and a middle portion of the connector strap extends between the first portion and the second portion, the middle portion coupled to the anchor and extending vertically either up or down along the housing to the post.

3. The quick-release respirator of claim 2, wherein the lower strap forms a combination strap comprising an elastic cord.

4. The quick-release respirator of claim 3, wherein the connector strap terminates at the anchor on the actuator such that the first portion of the connector strap that is coupled to the upper strap is discontinuous with the second portion of the connector strap that is coupled to the lower strap, and wherein the upper strap is a combination strap comprising an elastic cord, and wherein the upper strap and the lower strap are each sewn to the connector strap.

5. The quick-release respirator of claim 3, further comprising a second guide and a third guide, wherein the upper strap passes through the guide, the second guide, and extends around the post and is coupled to the anchor, and wherein the lower strap passes through the third guide and is coupled to the anchor.

6. The quick-release respirator of claim 2, wherein the post is located below the pivot of the actuator, wherein the first portion of the connector strap extends from the upper strap vertically downwards to the post and the middle portion of the connector strap extends vertically upwards from the post to the anchor, and wherein the second portion of the connector strap extends from the lower strap to the anchor.

7. The quick-release respirator of claim 6, wherein the pivot is centrally located in a vertical direction of the housing and the post is located near a bottom of the housing, and wherein a locking end of the actuator is positioned between the pivot and the guide in the locked position.

8. The quick-release respirator of claim 2, wherein the post is located above the pivot of the actuator, wherein the second portion of the connector strap extends from the lower strap to the post and the middle portion of the connector strap extends from the post to the anchor, and wherein the first portion of the connector strap extends from the upper strap to the anchor.

9. The quick-release respirator of claim 8, wherein the pivot is centrally located in a vertical direction and the post is located above the pivot on the housing, and wherein a locking end of the actuator is position below the pivot and the post in the locked position.

10. A quick-release respirator, comprising:

a housing configured to form an internal airspace between the housing and a user's face, the housing comprising a guide and a post;

a gasket coupled to the housing that forms a seal of the internal airspace;

a filter coupled to the housing that restricts air from transiting into the internal airspace of the housing without also transiting the filter;

an actuator that rotates about a pivot relative to the housing between an unlocked position and a locked position, the actuator comprising an anchor; and a support strap comprising:

a head strap configured to be positioned to surround a back of a user's head; and a neck strap configured to be positioned to surround the back of the user's head or neck below the head strap;

wherein the actuator engages both the head strap and the neck strap in the locked position;

wherein the support strap further comprises a connector strap extending between the head strap and neck strap;

wherein the post is positioned along an edge of the housing and is centrally located in a horizontal direction on the housing, the post comprising:

a first end configured to engage a first portion of the connector strap; and a second end of the post opposite the first end, the second end configured to engage a second portion of the connector strap.

11. The quick-release respirator of claim 10, further comprising an exhaust valve coupled to the housing that permits air to exit the internal airspace, wherein the connector strap extends from the head strap through the guide to the post along a front surface of the housing and returns from the post to the anchor along the front surface of the housing, the connector coupled to the actuator, the connector further extending from the anchor to the neck strap.

12. The quick-release respirator of claim 11, wherein the head strap and the neck strap each comprise an elastic member inside a sheath, wherein a strain of the head strap and a strain of the neck strap is greater than a strain of the connector strap when the support strap is stretched.

13. The quick-release respirator of claim 12, wherein the sheath covers a joint between the connector strap and the head strap.

14. The quick-release respirator of claim 11, wherein a length of the connector strap between the guide and the anchor is more than twice a length of the head strap.

15. The quick-release respirator of claim 11, wherein a length of the connector strap between the head strap and the anchor is more than twice a length of the connector between the neck strap and the anchor.

16. The quick-release respirator of claim 11, wherein the head strap and the neck strap each comprise an elastic member, wherein a strain of the head strap and a strain of the neck strap is greater than a strain of the connector strap when the support strap is stretched.

17. The quick-release respirator of claim 10, wherein the guide is located above both the pivot and the post on the housing, and wherein the pivot of the actuator is centrally located in a vertical direction on the housing, and wherein the anchor is between the pivot and the guide when the actuator is in the locked position.

18. The quick-release respirator of claim 17, wherein the post is located below the pivot, and wherein a locking end of the actuator is above the pivot and above the post when the actuator is in the locked position.

19. A quick-release respirator, comprising:

a housing configured to form an internal airspace between the housing and a user's face, the housing comprising a guide and a post;

a gasket coupled to the housing that forms a seal of the internal airspace;

a filter coupled to the housing that restricts air from transiting into the internal airspace of the housing without also transiting the filter;

an actuator that rotates about a pivot relative to the housing between an unlocked position and a locked position, the actuator comprising an anchor on a locking end of the actuator opposite the pivot; and an upper strap configured to be positioned to surround a back of a user's head, the upper strap coupled to the actuator; and a lower strap configured to be positioned to surround the back of the user's head or neck, the lower strap coupled to the actuator;

a connector strap extending between the upper strap and the lower strap;

wherein the post is positioned along an edge of the housing and is centrally located in a horizontal direction on the housing, the post comprising:

a first end configured to engage a first portion of the connector strap; and a second end of the post opposite the first end, the second end configured to engage a second portion of the connector strap; and wherein the pivot is centrally located in a vertical direction on the housing between the post and the guide and the post is located vertically above or below the pivot on the housing.

20. The quick-release respirator of claim 19, further comprising an exhaust valve coupled to the housing that permits air to exit the internal airspace.

21. The quick-release respirator of claim 20, wherein the post is located above the pivot of the actuator, and wherein a length of the connector strap extending between the anchor and the lower strap is at least twice a length of the connector strap extending between the anchor and the upper strap.

22. The quick-release respirator of claim 19, wherein in the locked position the anchor is between the pivot and the post, wherein the post is located vertically nearer a bottom of the housing than the anchor.

23. The quick-release respirator of claim 19, further comprising a second guide and a third guide, wherein the lower strap passes through the guide, the second guide, and returns around the post and is coupled to the anchor, and wherein the upper strap passes through the third guide and is coupled to the anchor.

* * * * *